US010514631B2

(12) United States Patent
Katsumata

(10) Patent No.: US 10,514,631 B2
(45) Date of Patent: Dec. 24, 2019

(54) TONER CONVEYANCE APPARATUS AND IMAGE BEARING MEMBER UNIT

(71) Applicant: CANON KABUSHIKI KAISHA, Tokyo (JP)

(72) Inventor: Go Katsumata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/251,110

(22) Filed: Jan. 18, 2019

(65) Prior Publication Data

US 2019/0235414 A1 Aug. 1, 2019

(30) Foreign Application Priority Data

Jan. 29, 2018 (JP) ..... 2018-013001

(51) Int. Cl.
*G03G 15/08* (2006.01)
*G03G 21/10* (2006.01)

(52) U.S. Cl.
CPC ..... *G03G 15/0867* (2013.01); *G03G 21/105* (2013.01)

(58) Field of Classification Search
CPC ..... G03G 15/0822; G03G 15/0865; G03G 15/0867; G03G 21/105; G03G 2215/0802
USPC ..... 399/107, 110, 111, 119, 120, 252–256, 399/262, 263, 358–360
See application file for complete search history.

(56) References Cited

U.S. PATENT DOCUMENTS 8,116,662 B2 * 2/2012 Ohta ..... G03G 21/12 399/120
8,401,435 B2 * 3/2013 Shima ..... G03G 15/0872 399/254
9,188,938 B2 * 11/2015 Ushikubo ..... G03G 21/12
9,703,253 B2 * 7/2017 Tomita ..... G03G 21/105

FOREIGN PATENT DOCUMENTS

JP 2010-170159 A 8/2010

* cited by examiner

*Primary Examiner* — Hoan H Tran
(74) *Attorney, Agent, or Firm* — Venable LLP

(57) ABSTRACT

A toner conveyance apparatus includes a conveyance coil and a regulation member. The conveyance coil includes a coil portion, an extended portion, a first engaging portion and a connecting portion. The regulation member includes a second engaging portion, a space portion and an opening portion. The connecting portion includes a first end portion that is connected to the extended portion and a second end portion that is connected to the first engaging portion, the first end portion being arranged further on the other end side than the second end portion. The second engaging portion includes a diameter reduction area whose distance in a radial distance from the rotational axis is reduced gradually toward the other end side such that the connecting portion and the regulation member are not in contact with each other when the conveyance coil is driven.

18 Claims, 17 Drawing Sheets

TONER CONVEYANCE APPARATUS AND IMAGE BEARING MEMBER UNIT

BACKGROUND OF THE INVENTION

Field of the Invention

The present invention relates to a toner conveyance apparatus and an image bearing member unit of an image forming apparatus that adopts an electrophotographic system, an electrostatic recording system and so on.

Description of the Related Art

In image forming apparatuses using a two-component developer, after toner images formed on image bearing members such as a photosensitive drum or an intermediate transfer belt are transferred, transfer residual toner, referred to as collected toner, remaining on the image bearing member is removed by a cleaning device and collected. The collected toner removed by the cleaning device and collected is conveyed by a toner conveyance apparatus and stored in a toner storage portion. Various types of toner conveyance members can be adopted in the toner conveyance apparatus, such as a screw-type member having a core shaft and a blade, or a coil-type member without a core shaft, and from the viewpoint of cost, a coil-type member without a core shaft is preferable. However, the coil-type toner conveyance member without the core shaft having a high stiffness has a drawback in that it is difficult to reduce dimensional errors, and that the total length varies greatly. Especially if the total length of the conveyance coil is longer than a prescribed dimension, there is a chance that a leading end portion of the conveyance coil on a downstream side in the toner conveyance direction protrudes from a leading end portion of the toner conveyance path and interferes with other components in the apparatus body.

A toner conveyance apparatus having a regulation member for regulating a leading end portion of a conveyance coil provided on a leading end portion of the toner conveyance path is proposed (refer to Japanese Patent Application Laid-Open Publication No. 2010-170159). According to this toner conveyance apparatus, even if the conveyance coil is longer than a prescribed dimension, the regulation member abuts against a leading end portion of the conveyance coil and regulates the total length of the conveyance coil, thereby preventing the leading end portion of the conveyance coil from being protruded and interfering with other components.

However, according to the toner conveyance apparatus disclosed in the above-described Japanese Patent Application Laid-Open Publication No. 2010-170159, abnormal noise may be generated by the conveyance coil serving as a toner conveyance member rotating in a state where the conveyance coil and the regulation member are abutted against one another.

SUMMARY OF THE INVENTION

According to a first aspect of the present invention, a toner conveyance apparatus includes a conveyance coil that is provided rotatably and configured to convey toner in a conveyance path, the conveyance coil comprising a coil portion wound helically around a rotational axis of the conveyance coil, an extended portion extending along a rotational axis direction from the coil portion, a first engaging portion provided around the rotational axis of the conveyance coil to engage an end portion on one end side of the conveyance coil, and a connecting portion, bending toward an outside in a radial direction of the conveyance coil and extending in the radial direction of the conveyance coil, configured to connect the extended portion and the first engaging portion, and a regulation member provided non-rotatably in the conveyance path and engaging with the first engaging portion and regulating the first engaging portion from moving to the other end side in a state where the end portion on the one end side of the conveyance coil attempts to move toward the other end side. The regulation member comprises a second engaging portion that is engaged with the first engaging portion, a space portion through which the extended portion passes, and an opening portion that is opened to a radial direction of the conveyance coil. The extended portion is arranged into the space portion through the opening portion. The connecting portion comprises a first end portion that is connected to the extended portion and a second end portion that is connected to the first engaging portion, the first end portion being arranged further on the other end side than the second end portion. The second engaging portion comprises a diameter reduction area whose distance in a radial distance from the rotational axis is reduced gradually toward the other end side such that the connecting portion and the regulation member are not in contact with each other in a state where the conveyance coil is driven.

According to a second aspect of the present invention, a toner conveyance apparatus includes a conveyance coil that is provided rotatably and configured to convey toner in a conveyance path, the conveyance coil comprising a coil portion wound helically around a rotational axis of the conveyance coil, an extended portion extending along a rotational axis direction from the coil portion, a first engaging portion provided around the rotational axis of the conveyance coil to engage an end portion on one end side of the conveyance coil, and a connecting portion, bending toward an outside in a radial direction of the conveyance coil and extending in the radial direction of the conveyance coil, configured to connect the extended portion and the first engaging portion, and a regulation member provided non-rotatably in the conveyance path and engaging with the first engaging portion and regulating the first engaging portion from moving to the other end side in a state where the end portion on the one end side of the conveyance coil attempts to move toward the other end side. The regulation member comprises a second engaging portion that is engaged with the first engaging portion, a space portion through which the extended portion passes, and an opening portion that is opened to a radial direction of the conveyance coil. The extended portion is arranged into the space portion through the opening portion. The connecting portion comprises a first end portion that is connected to the extended portion and a second end portion that is connected to the first engaging portion, the first end portion being arranged further on the other end side than the second end portion. An angle $\phi 1$ formed by the connecting portion and a plane orthogonal to the rotational axis direction is smaller than an angle $\phi 2$ formed by the plane and the second engaging portion in an engaging position where the first engaging portion and the second engaging portion are engaged.

According to a third aspect of the present invention, an image bearing member unit includes an image bearing member configured to bear a toner image and move, a cleaning member configured to remove toner on the image bearing member, and the toner conveyance apparatus configured to convey toner removed by the cleaning member.

Further features of the present invention will become apparent from the following description of exemplary embodiments with reference to the attached drawings.

DESCRIPTION OF THE EMBODIMENTS

First Embodiment

Figure 1:
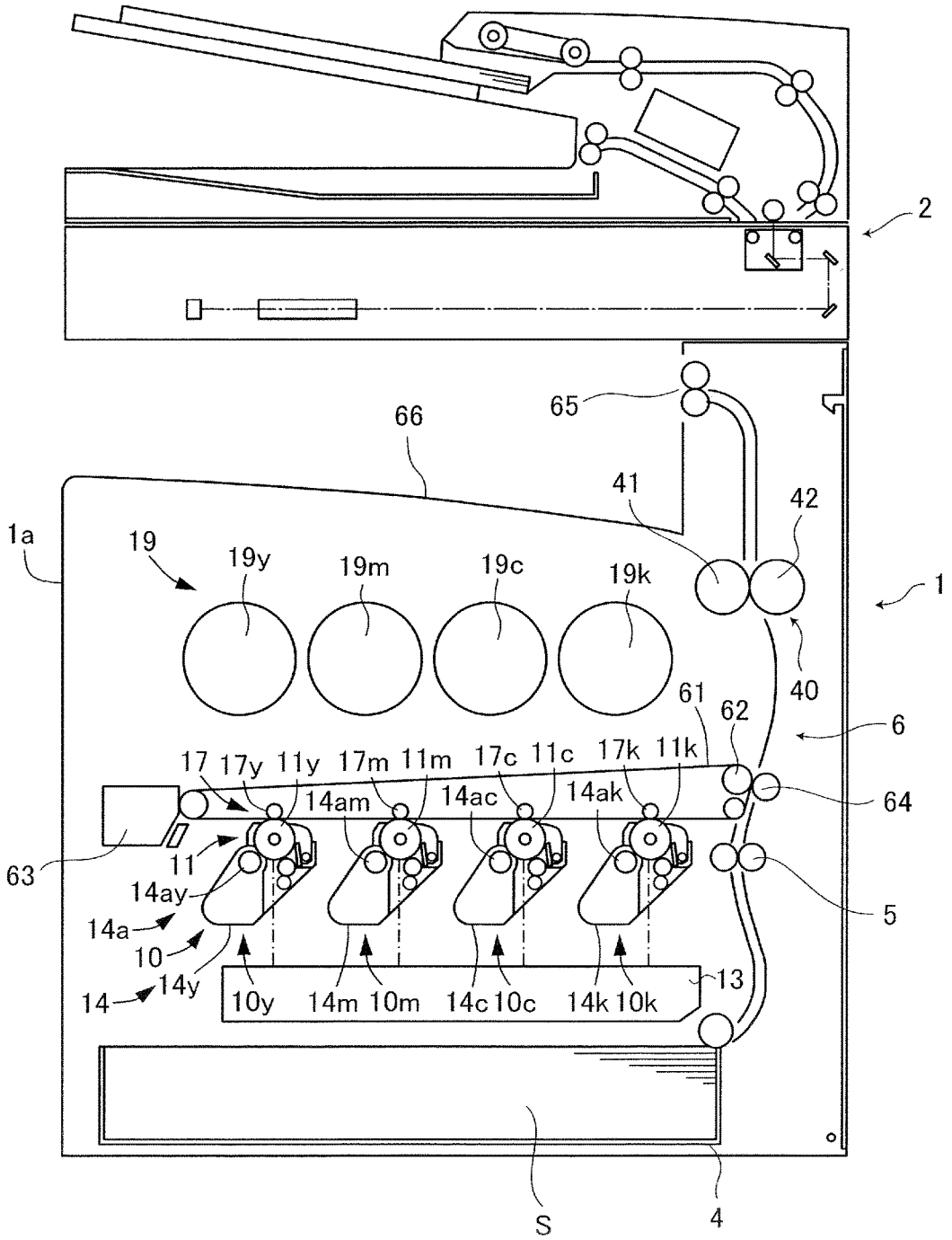
FIG. 1 is a cross-sectional view illustrating a general configuration of an image forming apparatus according to a first embodiment.

Now, a first embodiment of the present invention will be described in detail with reference to FIGS. 1 through 8. A tandem-type full-color printer is described as an example of an image forming apparatus 1 according to the present embodiment. However, the present invention is not restricted to tandem-type image forming apparatuses, and it can be other types of image forming apparatuses, and a monochrome or mono-color printer instead of a full-color printer. Further, necessary devices, equipment, casing and the like may be added to an apparatus such as a printer, various types of printing machines, copying machines, facsimiles, multifunction machines and so on to be used for various purposes.

According further to the present embodiment, the image forming apparatus 1 includes an intermediate transfer belt 61, and adopts a secondary transfer system in which toner images of respective colors are primarily transferred from photosensitive drums 11 to the intermediate transfer belt 61, and thereafter, the composite toner image of respective colors is collectively secondarily transferred to the sheet S. The present invention is not restricted to this example, and a system where an image is directly transferred from the photosensitive drums to a sheet conveyed on a sheet conveyor belt may also be adopted. Further, the present embodiment uses a two-component developer, which is a mixture of nonmagnetic toner and magnetic carrier, as developer. Actual examples of sheet S serving as recording material on which a toner image is formed include normal paper, resin sheet serving as substitute for normal paper, cardboard, overhead projector sheet and so on.

Image Forming Apparatus

The image forming apparatus 1 includes image forming units 10*y*, 10*m*, 10*c* and 10*k* of respective colors of Y (yellow), M (magenta), C (cyan) and K (black). The image forming units 10*y*, 10*m*, 10*c* and 10*k* are disposed independently for each of the four colors with a similar configuration. Therefore, in FIG. 1, the respective configurations of the four colors are denoted with the same reference number having a color identifier added at the end of the reference number, but in the present specification, sometimes the component is referred to as an image forming unit 10 without the color identifier. Similarly, a color identifier is added to the end of the respective reference numbers for the photosensitive drum 11, a developing apparatus 14, a developing sleeve 14*a*, a primary transfer roller 17 and a toner cartridge 19 described later for the respective configurations of the four colors in FIG. 1, but in the present specification, sometimes the components are denoted with only the reference numbers without the color identifiers.

The image forming apparatus 1 according to the present embodiment is a so-called tandem-type configuration in which the image forming units 10 of respective colors are arranged along a direction of rotation of the intermediate transfer belt 61. In the image forming units 10 of the respective colors, image forming is formed as follows. The photosensitive drums 11*y*, 11*m*, 11*c* and 11*k* serving as an example of an image bearing member has a surface thereof charged uniformly by a charge roller 12, and thereafter, a latent image is formed on the surface thereof by a laser scanner 13 driven according to an image information signal being transmitted. In other words, the photosensitive drum 11 rotates and moves while bearing the toner image. The image forming apparatus 1 according to the present embodiment includes an image reading apparatus 2, and the above-described image information includes image information of documents read by the image reading apparatus 2 and image information transmitted from an external terminal such as a personal computer connected to the image forming apparatus 1.

The latent image formed on the photosensitive drums 11 as described above are visualized as toner images by the developing apparatuses 14*y*, 14*m*, 14*c* and 14*k*, and toner images corresponding to respective colors are formed on the photosensitive drum 11. The developing apparatus 14 includes developing sleeves 14*ay*, 14*am*, 14*ac* and 14*ak* serving as developer bearing members at positions opposed to the photosensitive drums 11. The developing sleeves 14*a* bear developer in the developing apparatus 14 and rotate, and by having a predetermined developing bias applied between the developing sleeves 14*a* and the photosensitive drums 11, toner is supplied to the photosensitive drums 11 and the latent images are developed by toner.

The toner images of respective colors formed on the photosensitive drums 11 are sequentially transferred to the intermediate transfer belt 61 by applying predetermined pressure and electrostatic load bias to the primary transfer rollers 17*y*, 17*m*, 17*c* and 17*k*. After transfer, the little amount of residual toner remaining on the photosensitive drums 11 is removed and collected by a cleaning blade 15 (refer to FIG. 3), and the apparatus is prepared for the subsequent image formation. According to such image forming process, toner in the developing apparatus 14 is consumed, and toner is supplied to the developing apparatus 14 from the toner cartridges 19*y*, 19*m*, 19*c* and 19*k*.

Meanwhile, the sheet S is fed one at a time from a sheet feed cassette 4 and conveyed to a registration roller pair 5. Skewing of the sheet S is corrected by abutting a leading end of the sheet against a nip portion of the registration roller pair 5 and forming a loop. Thereafter, the registration roller pair 5 conveys the sheet S to the area between the intermediate transfer belt 61 and a secondary transfer outer roller 64 at a matched timing with the toner image on the intermediate transfer belt 61. The toner image on the intermediate transfer belt 61 is transferred to the sheet S by applying predetermined pressure and electrostatic load bias at a nip portion between a driving roller 62 and the secondary transfer outer roller 64 that are arranged opposed to one another. After transfer, the little amount of residual toner remaining on the intermediate transfer belt 61 is removed and collected by a cleaning unit 63, and the apparatus is prepared for the subsequent image formation.

The toner image transferred to the sheet S is fixed to the sheet S by applying heat and pressured at a nip portion between a heating roller 41 and a pressing roller 42 of the fixing unit 40. The sheet S onto which the toner image is fixed is conveyed by a recording material conveyance unit 6 and discharged through a sheet discharge roller pair 65 to a sheet discharge tray 66.

Drum Cartridge

Figure 2:
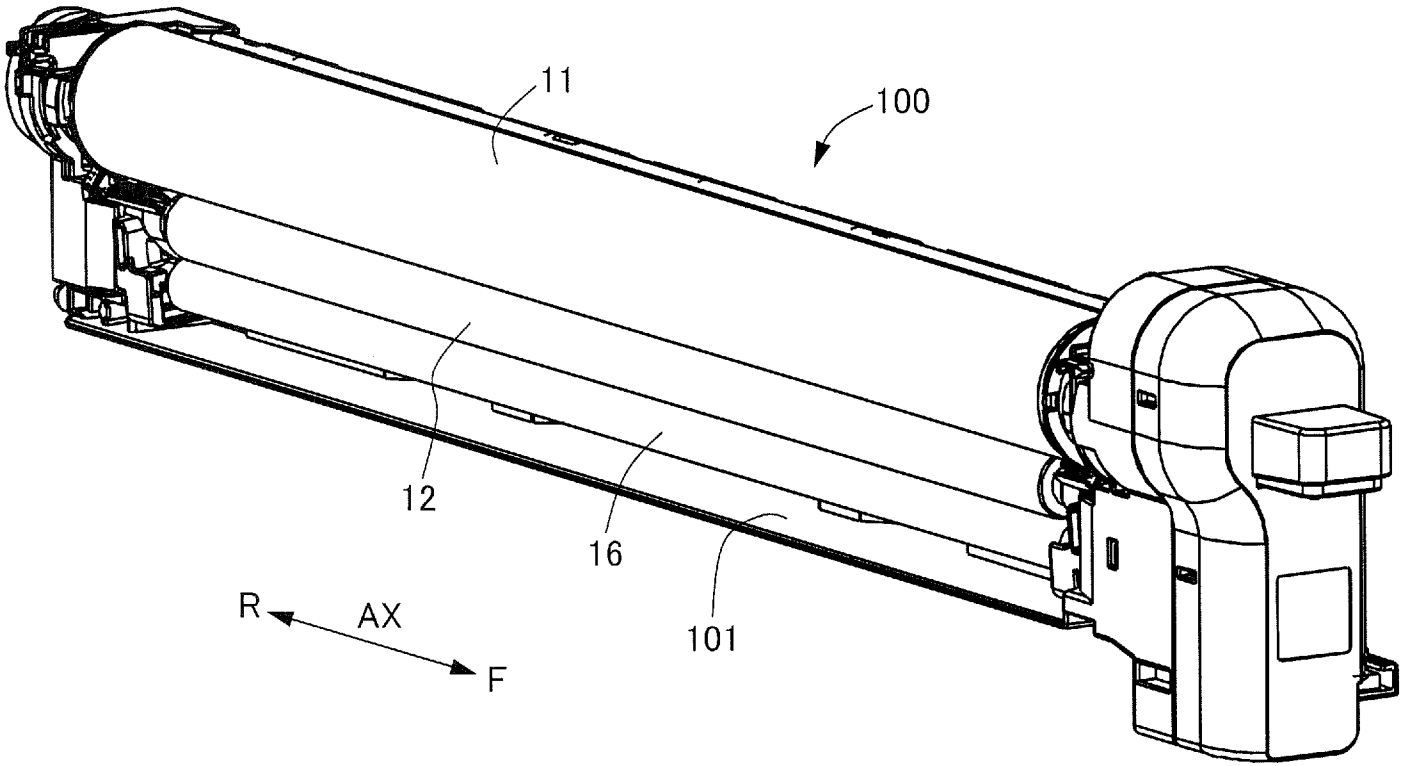
FIG. 2 is a perspective view illustrating a drum cartridge according to the first embodiment.
Figure 3:
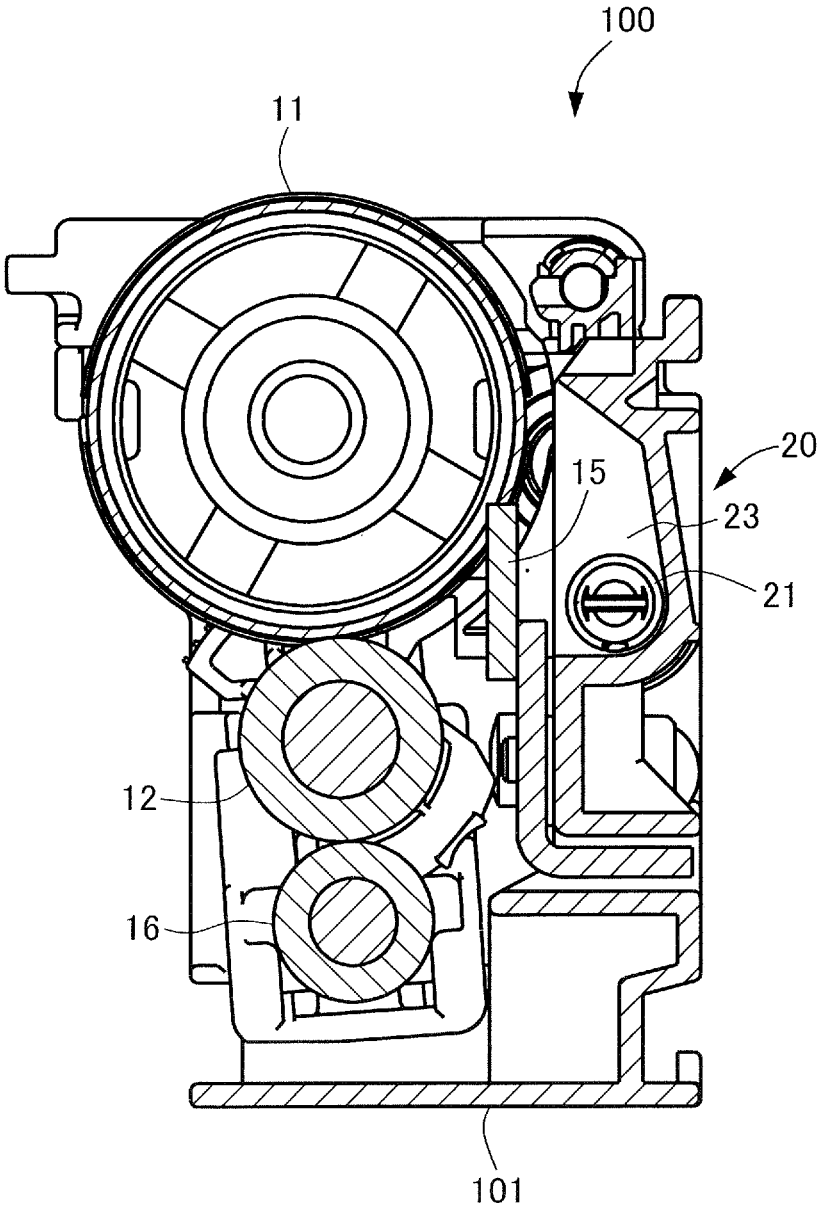
FIG. 3 is a cross-sectional view illustrating a drum cartridge according to the first embodiment.

In the case of the present embodiment, a drum cartridge, hereinafter referred to as cartridge, 100 serving as an example of an image bearing member unit that stores the photosensitive drum 11 is detachably attached to the apparatus body 1*a* in a replaceable manner. As illustrated in FIGS. 2 and 3, the cartridge 100 includes the photosensitive drum 11, the charge roller 12, a cleaning roller 16, and the cleaning blade 15 serving as an example of the cleaning member, which are supported integrally by a drum container 101. Further, the photosensitive drum 11, the charge roller 12 and the cleaning roller 16 are rotatably supported with respect to the drum container 101, wherein the charge roller 12 and the cleaning blade 15 are respectively supported in a state pressed against the photosensitive drum 11. Further, the cleaning roller 16 is supported in a state pressed against the charge roller 12. Therefore, in a state where the photosensitive drum 11 receives driving force from the apparatus body 1*a* and rotates, the charge roller 12 rotates by frictional force with the photosensitive drum 11, and the rotation of the charge roller 12 causes the cleaning roller 16 to rotate by frictional force with the charge roller 12. In FIG. 2 and so on, regarding a direction from a rear side of the apparatus body 1*a* toward a front side, i.e., predetermined direction, a downstream side is referred to as a front side, i.e., one end side, F, an upstream side is referred to as a rear side, i.e., the other end side, R, and front and rear direction of the front side F and the rear side R is referred to as a rotational axis direction AX.

As illustrated in FIG. 3, a toner conveyance apparatus 20 is provided near the cleaning blade 15 in the drum container 101. The toner conveyance apparatus 20 is provided to convey the toner having been removed and collected using the cleaning blade 15 from the photosensitive drum 11 by rotation of a conveyance coil 21 and discharge the toner from the cartridge 100 out to the apparatus body 1*a* (refer to FIG. 1).

Figure 4:
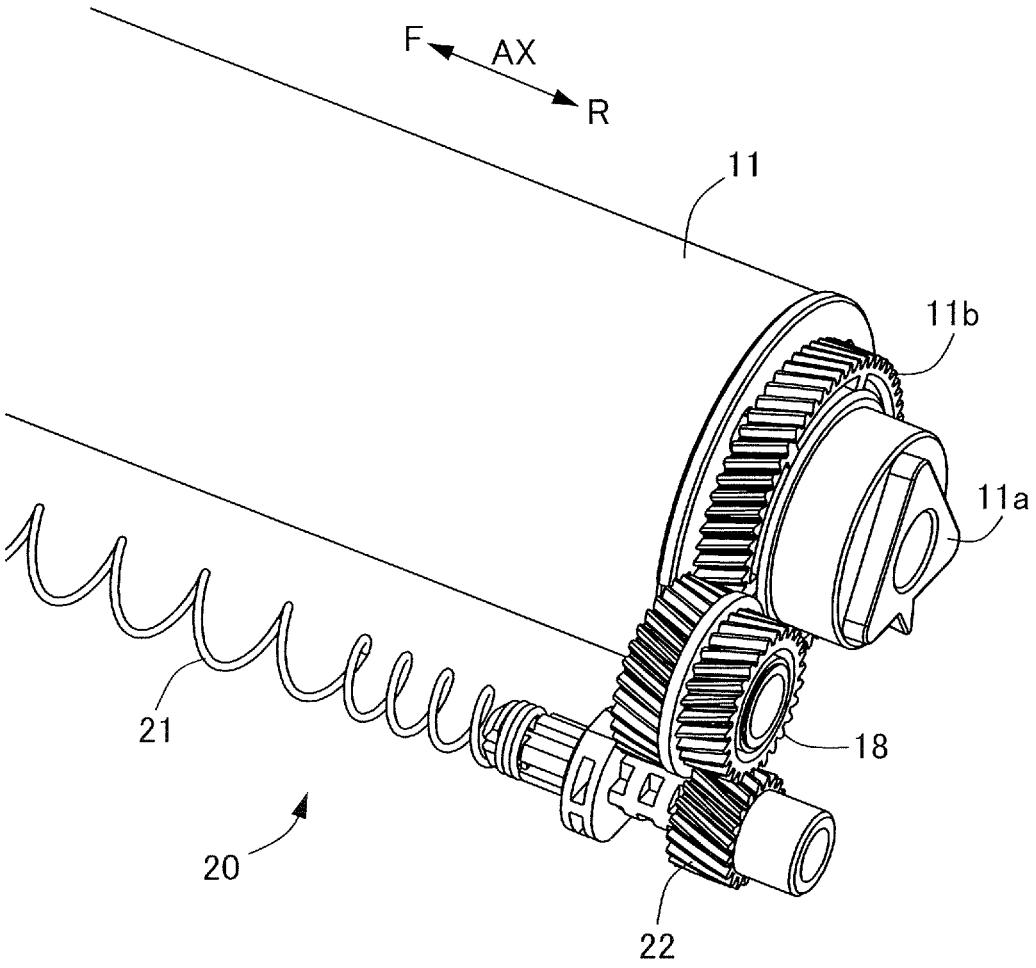
FIG. 4 is a perspective view illustrating a drive mechanism of a photosensitive drum and a conveyance coil according to the first embodiment.

As illustrated in FIG. 4, a coupling 11*a* and a drive gear 11*b* that are coupled to a driving source of the apparatus body 1*a* to receive driving force and rotate are provided coaxially with the photosensitive drum 11 on an end portion of the photosensitive drum 11 at a rear side R of the apparatus body 1*a* (refer to FIG. 1). A motor M (refer to FIG. 16A) is used, for example, as a driving source of the apparatus body 1*a*. A conveyance drive gear 22 for rotating the conveyance coil 21 is provided on the conveyance coil 21 at an end portion of a rear side R of the apparatus body 1*a*. The drive gear 11*b* and the conveyance drive gear 22 are coupled and driven via an idler gear 18.

Toner Conveyance Apparatus

Figure 5:
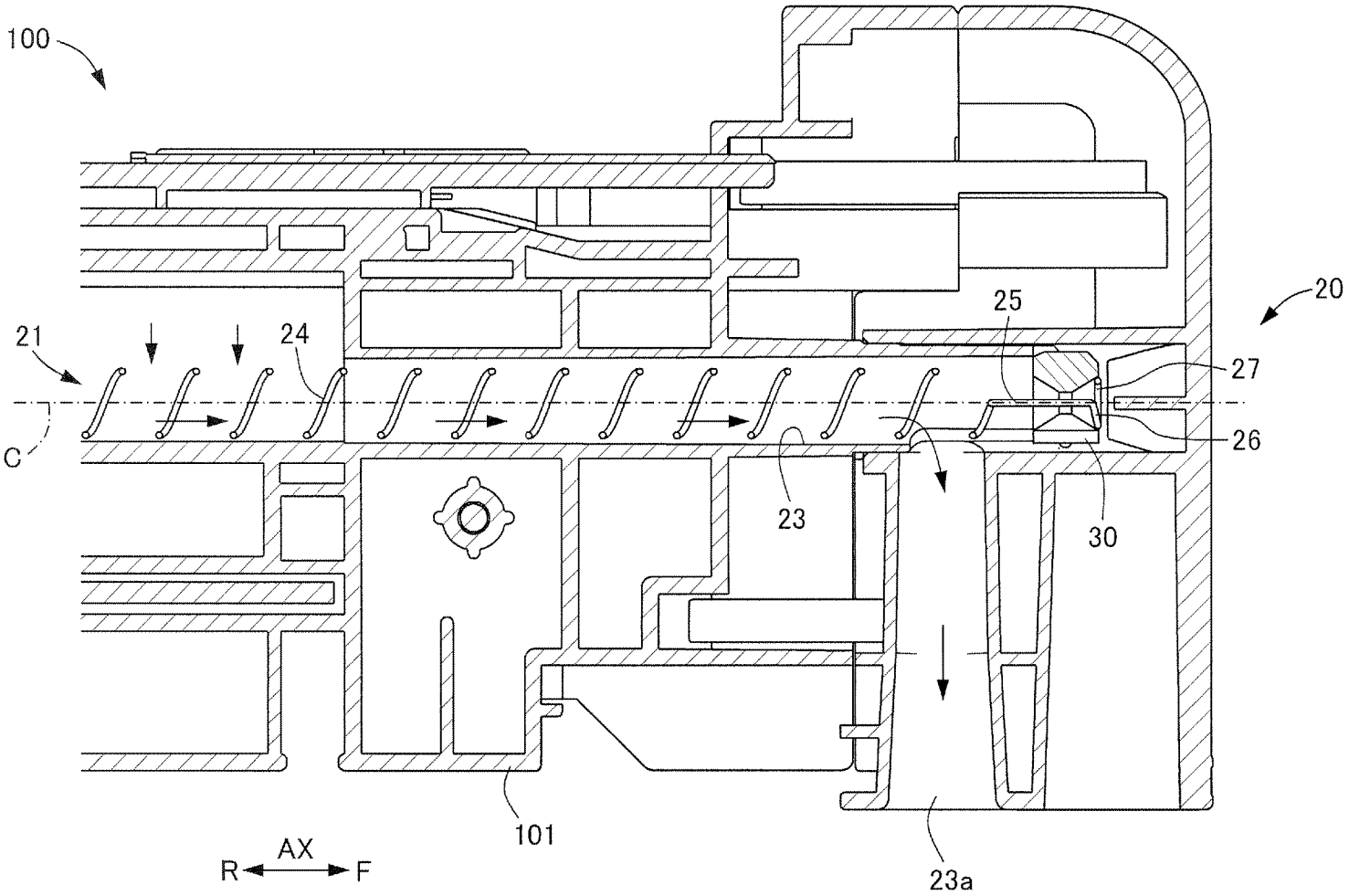
FIG. 5 is a cross-sectional view illustrating a toner conveyance apparatus according to the first embodiment.
Figure 16A:
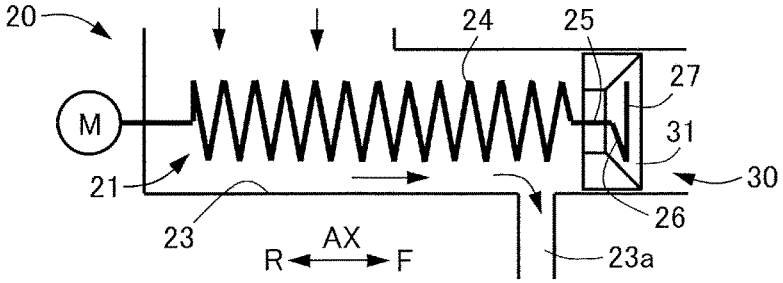
FIG. 16A is a cross-sectional view of a toner conveyance apparatus in which a toner conveyance direction is from a rear side toward a front side and a motor is arranged on the rear side.

As illustrated in FIG. 5 and FIG. 16A, the toner conveyance apparatus 20 includes a conveyance path 23 through which toner is conveyed with a front direction being a predetermined direction set as a toner conveyance direction, the conveyance coil 21, and a regulation member 30. The conveyance path 23 is defined by the drum container 101 and formed linearly with a front-to-rear direction set as the longitudinal direction, and is communicated with a toner discharge path 23*a* which is further communicated at a front side F with a toner storage portion not shown provided below the toner discharge path 23*a*. The conveyance coil 21 is disposed rotatably along the conveyance path 23 and receives rotary driving force at an end portion of the rear side R to rotate around the rotational axis and convey the toner in the conveyance path 23. Therefore, in a state where the conveyance coil 21 rotates along with the rotation of the photosensitive drum 11, the collected toner removed from the photosensitive drum 11 (refer to FIG. 3) by the cleaning blade 15 (refer to FIG. 3) and collected in the conveyance path 23 is conveyed toward the front side F by the rotating conveyance coil 21. The toner enters the toner discharge path 23*a* through the conveyance path 23, falls while being guided by the toner discharge path 23*a* and is discharged from the cartridge 100 to the toner storage portion.

As illustrated in FIGS. 6A, 6B, 7 and 8, the conveyance coil 21 is formed by bending a single wire made of metal, and it includes a coil portion 24, an extended portion 25, a connecting portion 26 and a first engaging portion 27. The coil portion 24 is wound helically around a center line C of the conveyance coil 21 and conveys the toner in the conveyance path 23 when rotated. In the present embodiment, the center line C is a rotational axis of the conveyance coil 21, and a direction of the center line C corresponds to a rotational axis direction AX. The extended portion 25 extends linearly along the rotational axis direction AX from the end portion on the front side F of the coil portion 24. In the present embodiment, the extended portion 25 is disposed along the center line C of the conveyance coil 21.

The first engaging portion 27 is disposed at the end portion on the front side F of the conveyance coil 21, and it is arranged along a plane intersecting the rotational axis direction AX. The first engaging portion 27 is designed such that the distance from the center line C is longer than the distance from the extended portion 25 to the center line C, for example. In the present embodiment, the first engaging portion 27 has an approximately circular shape which is concentric to the center line C of the conveyance coil 21, and it is formed by bending the wire in an approximately circular shape, along a plane orthogonal to the rotational axis direction AX, when viewed from the rotational axis direction AX.

The connecting portion 26 connects the extended portion 25 and the first engaging portion 27, and in the present embodiment, it is formed in a straight line such that the angle formed by the connecting portion 26 and the extended portion 25 is θ1. The connecting portion 26 includes a first end portion 26*a* which is an end portion of a side connected to the extended portion 25 and a second end portion 26*b* which is an end portion of a side connected to the first engaging portion 27. The first end portion 26*a* is arranged on a rear side R than the second end portion 26*b*.

The regulation member 30 is formed of synthetic resin, for example, which is provided non-rotatably on an end portion on the front side F of the conveyance path 23 for regulating the length of the conveyance coil 21, and includes a second engaging portion 31 engageable with the first engaging portion 27, a storage portion 32, serving as a space portion, and an opening portion 33 formed as a cutout. The first engaging portion 27 of the conveyance coil 21 is engaged by being abutted against the second engaging portion 31 toward the rear side R in a state being pulled toward the rear side R by tensile force of the coil portion 24. The regulation member 30 is capable of regulating the first engaging portion 27 from moving toward the rear side R by engaging with the first engaging portion 27 in a state where an end portion on the front side F of the conveyance coil 21 attempts to move toward the rear side R. The center line C of the regulation member 30 corresponds to the center line C of the conveyance coil 21 being engaged. A fixing rib 34 for fixing the regulation member 30 to the conveyance path 23 and preventing rotation and removal of the regulation member 30 is provided on an outer circumference portion of the regulation member 30 regarding a direction intersecting the rotational axis direction AX.

The storage portion 32 is provided between the conveyance path 23 and the second engaging portion 31, that is, on a rear side R of the second engaging portion 31, and arranged in a state such that a portion of the conveyance coil 21 is passed through the storage portion 32 in the rotational axis direction AX. In other words, the storage portion 32 is capable of storing at least either one of the extended portion 25 and the connecting portion 26. The storage portion 32 regulates movement of the extended portion 25 of the conveyance coil 21 toward a direction intersecting the rotational axis direction AX. Thereby, the amount of displacement of the end portion on the front side F of the conveyance coil 21 in a direction intersecting the rotational axis direction AX can be reduced, such that generation of abnormal noise by sliding of the outer circumferential surface of the conveyance coil 21 against the inner wall of the conveyance path 23 is reduced. The inner diameter of the storage portion 32 is formed smaller than a maximum outer diameter d1 of the first engaging portion 27. Therefore, the first engaging portion 27 is engaged to the second engaging portion 31 without entering the storage portion 32.

The opening portion 33 communicates the storage portion 32 with the outer side of the regulation member 30, and the width of the opening portion 33 in the direction of rotation of the conveyance coil 21 is equal to or greater than a wire diameter of the conveyance coil 21 such that the connecting portion 26 may enter the opening portion 33. In other words, the opening portion 33 is formed to open in the radial direction of the conveyance coil 21 such that at least one of the extended portion 25 and the connecting portion 26 housed in the storage portion 32 may be storable in the storage portion 32 from the radial direction of the conveyance coil 21. In the present embodiment, the opening portion 33 is an opening that is formed a cutout shape and opened across the entire area of the regulation member 30 in the rotational axis direction AX. The opening portion 33 is formed to allow the extended portion 25 and the connecting portion 26 to be attached to the storage portion 32 and the second engaging portion 31 from the outer side of the regulation member 30 regarding the direction intersecting with the rotational axis direction AX. In other words, the opening portion 33 has a width equal to or greater than the wire diameter of the conveyance coil 21 with respect to the rotational direction of the conveyance coil 21. Therefore, assembling workability of the conveyance coil 21 and the regulation member 30 may be facilitated.

The rotation of the conveyance coil 21 conveys the toner in the conveyance path 23 to the front side F. In this state, reaction force is applied on the rear side R of the conveyance coil 21 and the entire length of the conveyance coil 21 receives force toward the shrinking direction. The regulation member 30 provided at the end portion of the conveyance coil 21 on the front side F prevents the conveyance coil 21 from shrinking.

Figure 13A:
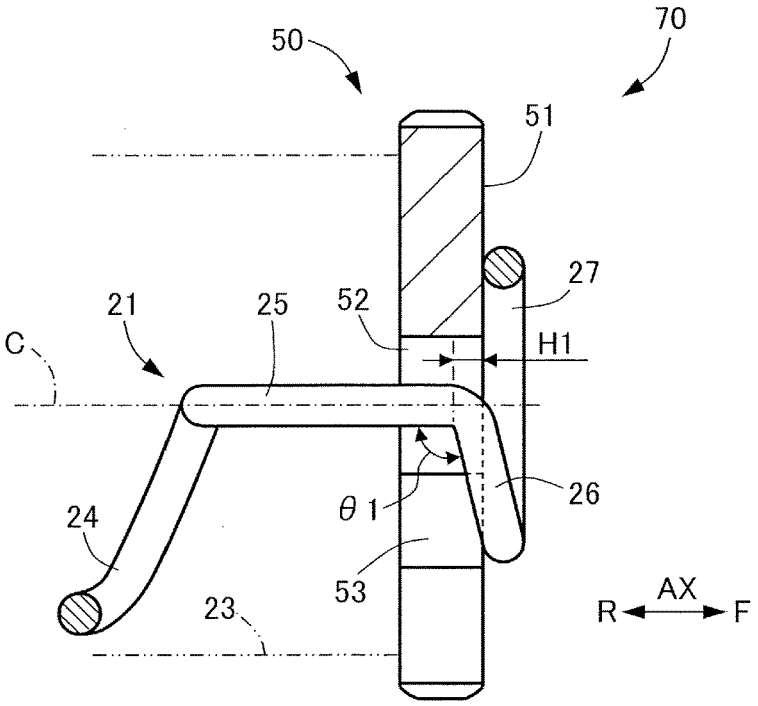
FIG. 13A is a cross-sectional side view illustrating a conveyance coil and a regulation member according to a comparative example.
Figure 13B:
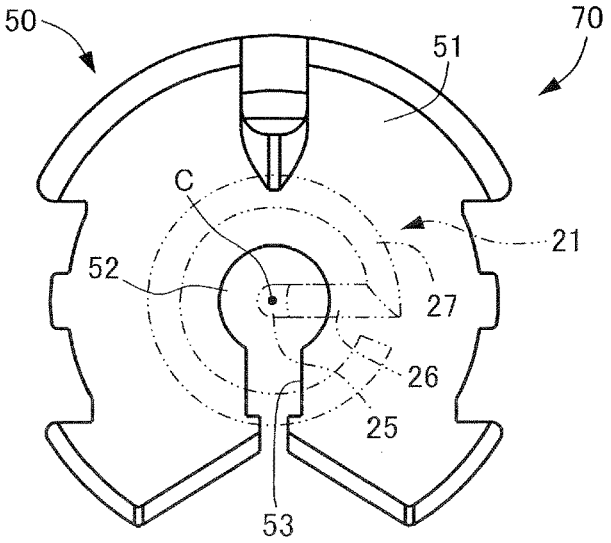
FIG. 13B is a front view of the conveyance coil and the regulation member according to the comparative example.
Figure 14:
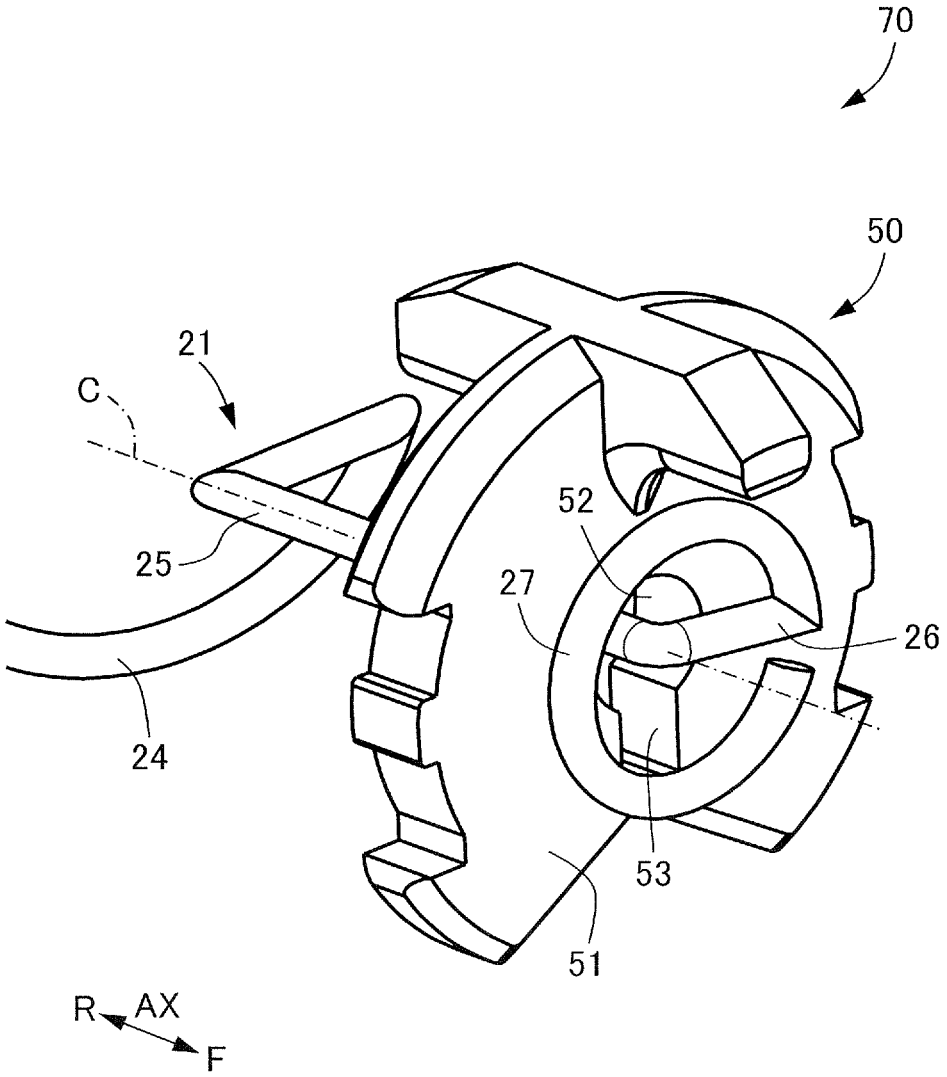
FIG. 14 is a perspective view of the conveyance coil and the regulation member according to the comparative example.

The conveyance coil used conventionally as conveyance member of the toner conveyance apparatus is advantageous in that it is inexpensive but is disadvantageous in that the entire length of the conveyance coil is uneven at the time of fabrication. Therefore, if the entire length of the conveyance coil is shorter than the prescribed size, a problem occurs in that the conveyance coil may not reach the toner discharge opening and collected toner may not be discharged from the cartridge. Thus, FIGS. 13A, 13B and 14 illustrate a comparative example of a toner conveyance apparatus 70 in which a first engaging portion 27 is provided at a leading edge of the conveyance coil 21 and a regulation member 50 is arranged to abut from an upstream side in the conveyance direction of the first engaging portion 27.

Now, the toner conveyance apparatus 70 according to a comparative example will be described. According to the toner conveyance apparatus 70 of the comparative example, a conveyance coil similar to the conveyance coil 21 adopted in the first embodiment described above is used, so that the same reference numbers are assigned to the conveyance coil 21 and detailed descriptions thereof are omitted. The regulation member 50 of the toner conveyance apparatus 70 is formed in the shape of a plate as whole, and includes a second engaging portion 51 formed on a side facing the front side F, a storage portion 52 that passes the center portion in the rotational axis direction AX, and an opening portion 53. The opening portion 53 is formed as a cutout that communicates a portion of the storage portion 52 and the outer circumference portion of the regulation member 30 in the radial direction. According to the toner conveyance apparatus 70, the spring property of the conveyance coil 21 allows the conveyance coil 21 to be extended throughout its entire length and regulated by the regulation member 50, to thereby prevent discharge failure of the collected toner that occurs in the above-described state where the total length of the conveyance coil 21 is shorter than a specified dimension.

Figure 15A:
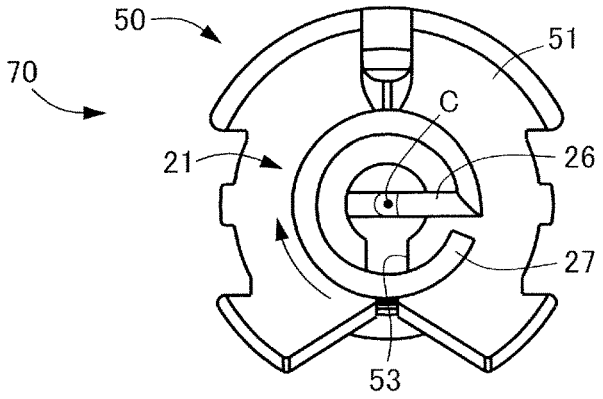
FIG. 15A is a front view of the conveyance coil and the regulation member according to the comparative example, illustrating a state before a connecting portion gets caught in an opening portion.
Figure 15B:
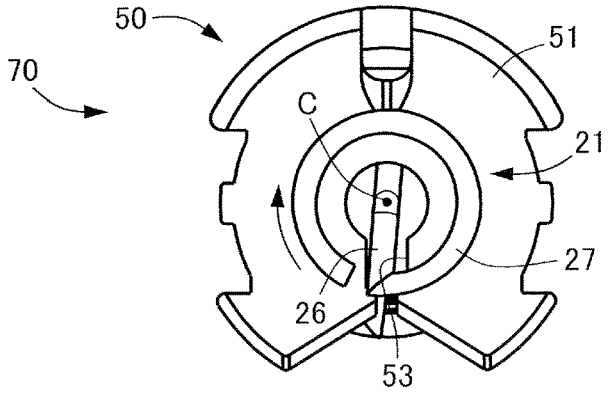
FIG. 15B is a front view of the conveyance coil and the regulation member according to the comparative example, illustrating a state in which the connecting portion is caught in the opening portion.
Figure 15C:
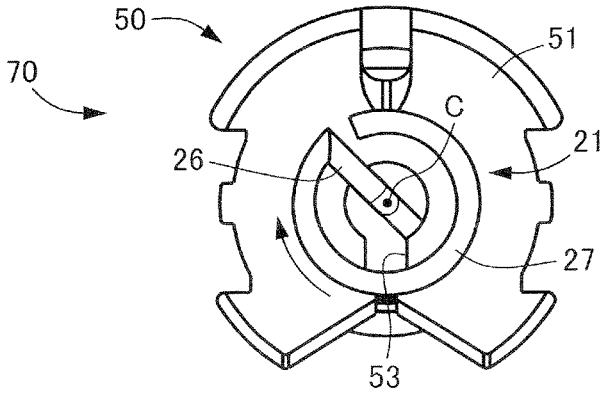
FIG. 15C is a front view of the conveyance coil and the regulation member according to the comparative example, illustrating a state in which the connecting portion is released from the opening portion.

However, according to the regulation member 50 of the comparative example, abnormal noise occurs between the conveyance coil 21 and the regulation member 50. We will describe the principle of generation of such abnormal noise. For example, it is assumed that the conveyance coil 21 rotates in a clockwise direction in sequential order of FIGS. 15A, 15B and 15C in the direction of the arrow illustrated in the drawings. In FIG. 15A, the connecting portion 26 is distant from the opening portion 53. If the conveyance coil 21 rotates, as illustrated in FIGS. 15B and 13A, sometimes the connecting portion 26 got stuck in the opening portion 53. If the conveyance coil 21 rotates while the connecting portion 26 is stuck in the opening portion 53, torsional force is accumulated in the conveyance coil 21. In FIG. 15C, if the conveyance coil 21 is rotated further and the connecting portion 26 is freed from the opening portion 53, the accumulated torsional force is released suddenly and abnormal noise is generated, which is a hindrance to reducing noise of the toner conveyance operation.

Due to the devoted studies of the present inventors, it has been discovered that the possibility of a sticking between the connecting portion 26 and the opening portion 53 causing abnormal noise is high if the angle θ1 formed by the connecting portion 26 and the extended portion 25 is great due to the difference in size of the conveyance coil 21. The angle θ1 of the conveyance coil 21 where abnormal noise has occurred was 105°. If the angle θ1 becomes greater than 90°, the bent height H1 of the connecting portion 26 increases and the connecting portion 26 tends to be caught in the opening portion 53. In contrast, if the angle θ1 is equal to or smaller than 90°, the first engaging portion 27 will constantly be in line contact with the second engaging portion 51, so that the connecting portion 26 is rarely caught in the opening portion 53. It may be possible to subject the conveyance coil 21 to secondary processing to approximate the angle θ1 to 90°, but in that case, the processing cost and time will be increased. It may be possible to prevent the connecting portion 26 from being caught in the opening portion 53 by additionally providing a member to close the opening portion 53 after attaching the conveyance coil 21 to the regulation member 50, but in that case, costs are increased and assembling workability is deteriorated by the increase in the number of components. The present embodiment aims at suppressing the generation of abnormal noise between the conveyance coil 21 and the regulation member 50. In other words, the regulation member is configured as described below to reduce abnormal noise that occurs between the conveyance coil 21 and the regulation member 50 and reduce noise of the toner conveyance apparatus 70 without increasing costs and deteriorating the assembling workability.

In the present embodiment, as illustrated in FIGS. 6A, 6B, 7 and 8, the second engaging portion 31 of the regulation member 30 includes an inclined surface 31*a* that is inclined such that the distance from the center line C to the regulation member 30 becomes gradually shorter from the front side F toward the rear side R. In other words, the inclined surface 31*a* is inclined such that the distance from the center line C to the inclined surface 31*a* is shorter toward the rear side R in the rotational axis direction AX. The second engaging portion 31 is formed such that in the cross section including the center line C, the contour line of the inclined surface 31*a* is formed in a straight line. The inclined surface 31*a* of the second engaging portion 31 is formed across the entire circumference in the direction of rotation of the conveyance coil 21 excluding the opening portion 33, and it is approximately cone-shaped. That is, the second engaging portion 31 is formed in a truncated cone shape that is continuous in the circumferential direction along the direction of rotation of the conveyance coil 21 excluding the opening portion 33. The inclined surface 31*a* is formed to have a maximum diameter d2 that is greater than the maximum outer diameter d1 of the first engaging portion 27 of the conveyance coil 21. Thus, the conveyance coil 21 is always stored within a space of the cone-shaped inclined surface 31*a*, and since the first engaging portion 27 is circular, the conveyance coil 21 is centered by the inclined surface 31*a*. Further, the inclined surface 31*a* forms a diameter reduction area in which the distance from the center line C reduces toward the rear side R so that the connecting portion 26 and the regulation member 30 do not contact each other when the conveyance coil 21 is driven. The first engaging portion 27 and the second engaging portion 31 are engaged at the diameter reduction area.

Further according to the present embodiment, the storage portion 32 includes an inner surface 32*a* that has a linear contour line along the rotational axis direction AX in a cross-section including the center line C. The angle formed by the connecting portion 26 and the extended portion 25 of the conveyance coil 21 is θ1, and in the cross-section including the center line C, the angle formed by a contour line of the inclined surface 31*a* of the second engaging portion 31 and a contour line of the inner surface 32*a* of the storage portion 32 is θ2. That is, θ2 is an angle formed by the contour line of the inclined surface 31*a* and a virtual line connected linearly from an end portion of the rear side R of the contour line of the inclined surface 31*a* toward the rear side R, and in the present embodiment, this virtual line is overlapped with the contour line of the inner surface 32*a* of the storage portion 32. In this case, the conveyance coil 21 and the regulation member 30 are formed to satisfy the following: $\theta 1<\theta 2$ and $90°<\theta 2<180°$. In the present embodiment, $90°<\theta 1<180°$ is satisfied, so that the following is satisfied: $90°<\theta 1<\theta 2<180°$. The angle $\theta 1$ formed by the connecting portion 26 and the extended portion 25 may also be equal to or smaller than 90°.

Figure 17:
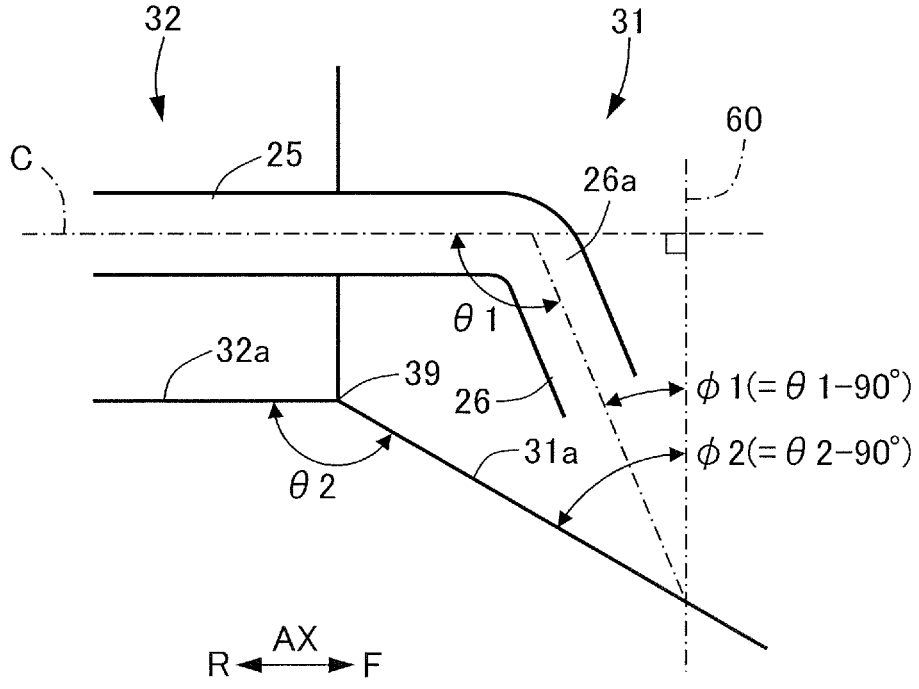
FIG. 17 is an enlarged cross-sectional side view of the conveyance coil and the regulation member according to the first embodiment.

Now, as illustrated in FIG. 17, an angle $\phi 1$ formed by the connecting portion 26 and a plane 60 orthogonal to the rotational axis direction AX is defined as $\theta 1$ minus 90°. Further, an angle $\phi 2$ formed by the plane 60 and the second engaging portion 31 in the engaging position in which the first engaging portion 27 and the second engaging portion 31 are engaged is defined as $\theta 2$ minus 90°. In this state, since $90°<\theta 1<180°$ is satisfied, $0°<\phi 1<90°$ is satisfied, and since $90°<\theta 2<180°$ is satisfied, $0°<\phi 2<90°$ is satisfied. Further, since $\theta 1<\theta 2$ is satisfied, $\phi 1<\phi 2$ is satisfied, and since $90°<\theta 1<\theta 2<180°$ is satisfied, $0°<\phi 1<\phi 2<90°$ is satisfied.

Figure 7:
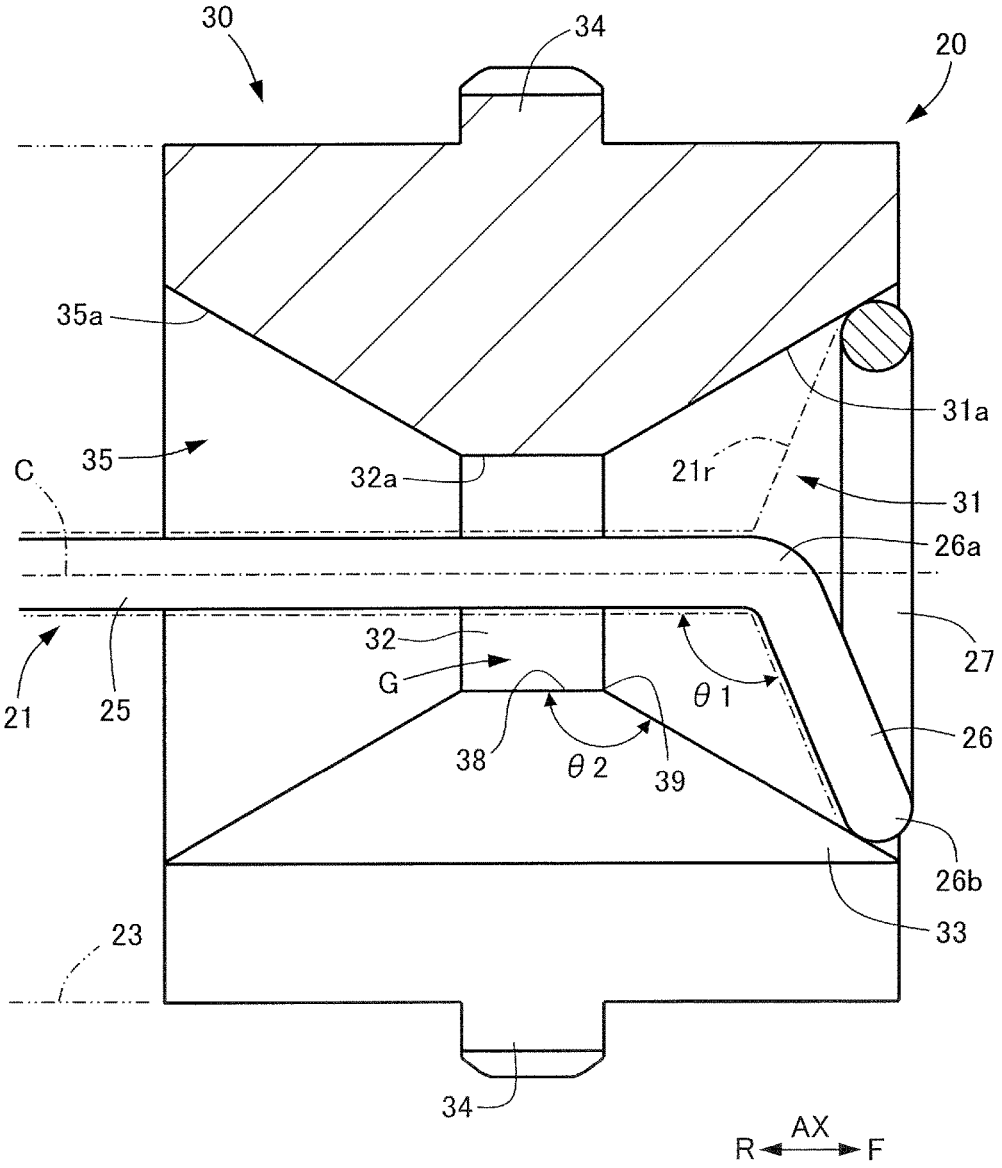
FIG. 7 is a cross-sectional side view of the conveyance coil and the regulation member according to the first embodiment.
Figure 8:
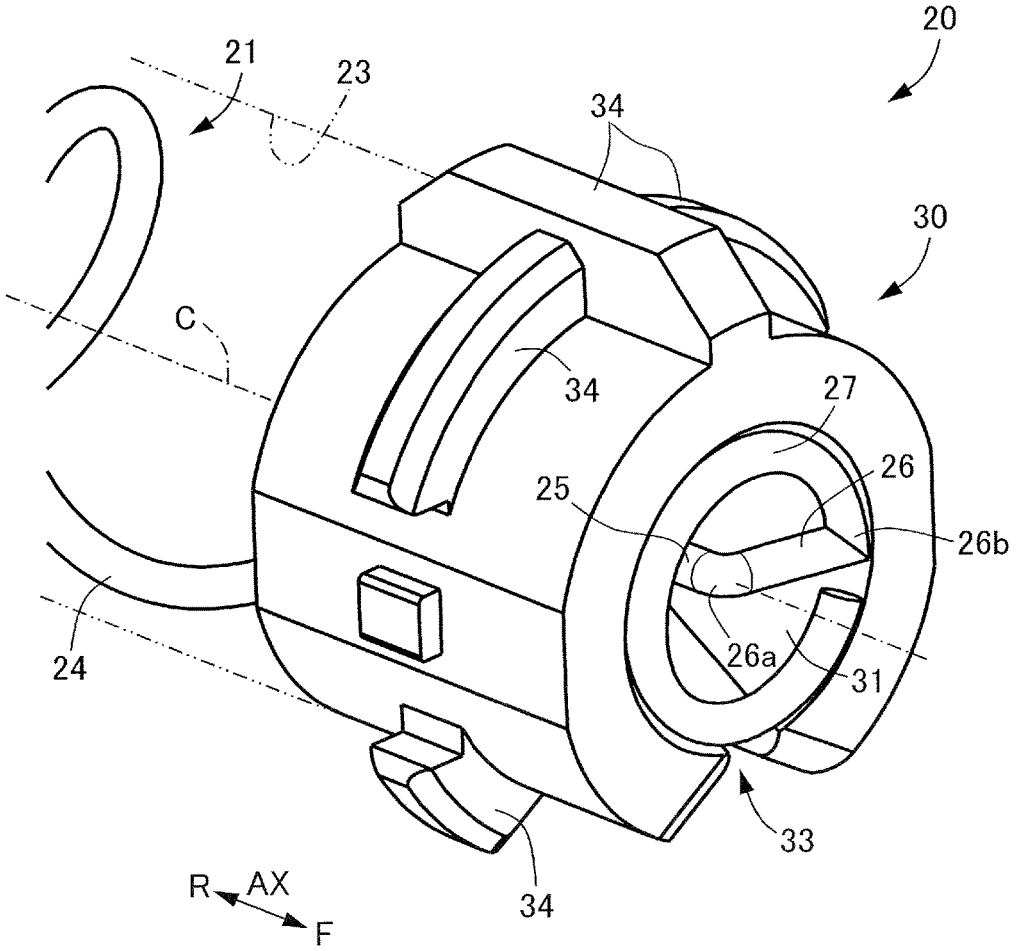
FIG. 8 is a perspective view illustrating the conveyance coil and the regulation member according to the first embodiment.

As described, by satisfying $\theta 1<\theta 2$, that is, $\phi 1<\phi 2$, the first engaging portion 27 and the inclined surface 31*a* of the second engaging portion 31 will always be in contact with one another, as illustrated in FIG. 7, while the connecting portion 26 of the conveyance coil 21 is not in contact with the regulation member 30. Now, we will consider a rotation trajectory 21*r* of the extended portion 25 and the connecting portion 26, especially the outer circumferential surface, in a state where the conveyance coil 21 is rotated around the rotational axis while the first engaging portion 27 pulled toward the rear side R is engaged with the inclined surface 31*a* of the second engaging portion 31. In this case, the rotation trajectory 21*r* of the extended portion 25 and the connecting portion 26 has a gap G regarding a portion 39 where the storage portion 32 and the opening portion 33 are connected. That is, the rotation trajectory 21*r* has a gap G with respect to the inclined surface 31*a* of the second engaging portion 31 and the inner surface 32*a* of the storage portion 32, and it is separated from the portion 39 where the inner surface 32*a* and the inclined surface 31*a* are connected. According to this arrangement, the connecting portion 26 is less likely to be caught in the opening portion 33.

Figure 6A:
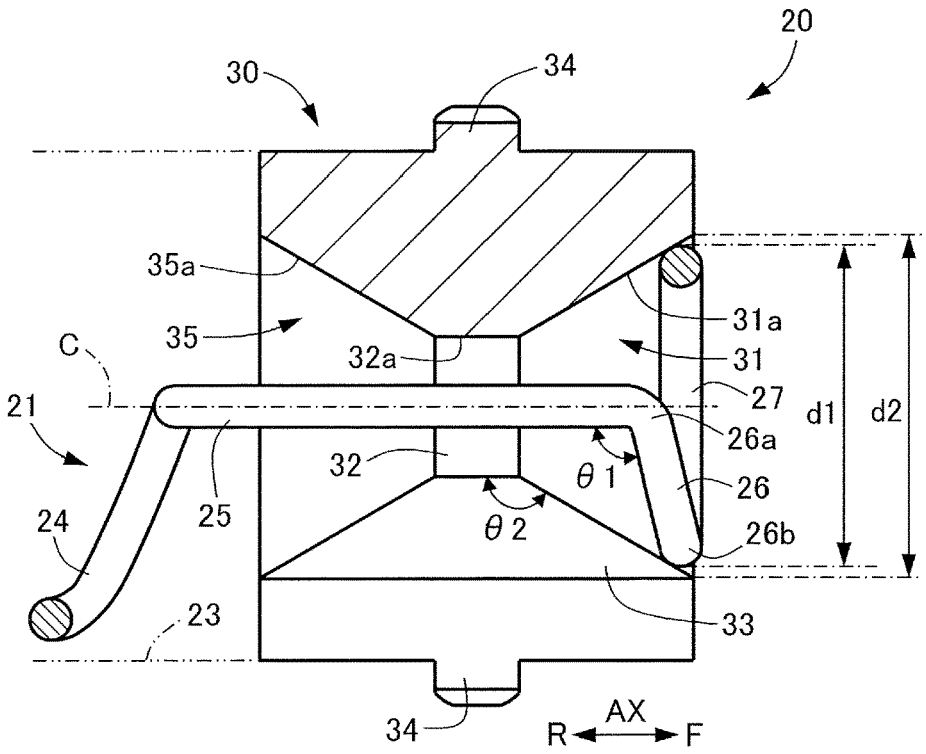
FIG. 6A is a cross-sectional side view of the conveyance coil and the regulation member according to the first embodiment.
Figure 6B:
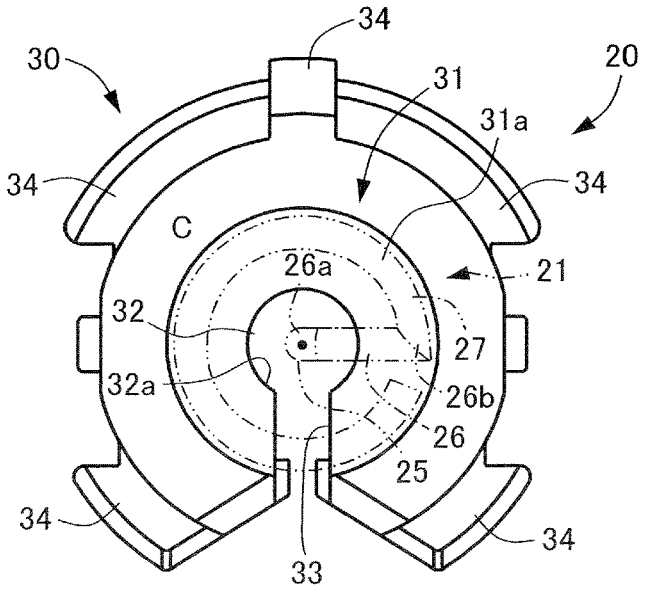
FIG. 6B is a front view of the conveyance coil and the regulation member according to the first embodiment.

Further, as illustrated in FIG. 6A, the regulation member 30 is formed in plane symmetry with respect to an orthogonal plane, orthogonal to the rotational axis, i.e., center line C, that passes a center position of the regulation member 30 in the direction of the center line C of the regulation member 30, i.e., the rotational axis direction AX of the conveyance coil 21. That is, the regulation member 30 is formed to be symmetrical with respect to the orthogonal plane being orthogonal to the rotational axis of the conveyance coil 21, the plane passing a center position of the regulation member 30 with respect to the rotational axis direction AX. That is, the second engaging portion 31, the storage portion 32 and the opening portion 33 of the regulation member 30 are formed on both sides of the rotational axis direction AX with the above-described orthogonal plane set as the center. Therefore, an approximately cone-shaped inclined portion 35 having an inclined surface 35*a* that is inclined so that the distance from the center line C to the surface becomes longer toward the rear side R is formed continuously from the storage portion 32 on the rear side R of the storage portion 32. In other words, the storage portion 32, the second engaging portion 31 and the opening portion 33 of the regulation member 30 are respectively formed on both sides of the plane that passes the center position of the rotational axis direction AX and is orthogonal to the center line C. The regulation member 30 can be assembled both normally and upside down to the conveyance path 23.

As described, according to the toner conveyance apparatus 20 of the present embodiment, the angle $\theta 1$ formed by the connecting portion 26 and the extended portion 25 of the conveyance coil 21 is smaller than the angle $\theta 2$ formed by the contour line of the inclined surface 31*a* of the second engaging portion 31 and the contour line of the inner surface 32*a* of the storage portion 32. In other words, the angle $\theta 1$ formed by the connecting portion 26 and the extended portion 25 of the conveyance coil 21 is smaller than the angle $\theta 2$ formed by the inclined surface 31*a* of the second engaging portion 31 and the rotational axis direction AX of the conveyance coil 21. Further, the first engaging portion 27 is engaged to the second engaging portion 31 by abutting against the inclined surface 31*a*. Therefore, the connecting portion 26 of the conveyance coil 21 will not be in contact with the regulation member 30, and the first engaging portion 27 will always be in contact with the inclined surface 31*a* of the second engaging portion 31. Further, the rotation trajectory 21*r* of the extended portion 25 and the connecting portion 26 has a gap with respect to the inclined surface 31*a* of the second engaging portion 31 and the inner surface 32*a* of the storage portion 32. Therefore, the sticking between the connecting portion 26 and the opening portion 33 causing abnormal noise will not generate, so that the generation of abnormal noise by the conveyance coil 21 and the regulation member 30 will be suppressed, and the noise of the toner conveyance apparatus 20 will be reduced.

According further to the toner conveyance apparatus 20 of the present embodiment, the inclined surface 31*a* is a continuous plane that is uninterrupted in the circumferential direction except for the opening portion 33, and the first engaging portion 27 is formed in an approximately circular shape. Therefore, even if the regulation member 30 is attached in an inclined manner, the conveyance coil 21 and the regulation member 30 will always be in contact with one another via multiple points, such that sudden changes of sliding contact points that may cause abnormal noise rarely occur, and the generation of abnormal noise will be suppressed effectively.

Conventionally, the regulation of movement of free end of the conveyance coil was realized by the extended portion 25 of the conveyance coil 21 being abutted against the storage portion 32 of the regulation member 30, wherein in a state where the extended portion 25 sank into the opening portion 33, the conveyance coil 21 was greatly displaced in the radial direction. In contrast, according to the toner conveyance apparatus 20 of the present embodiment, the maximum diameter d2 of the inclined surface 31*a* is greater than the maximum outer diameter d1 of the first engaging portion 27 of the conveyance coil 21, such that the conveyance coil 21 is always stored within the space of the second engaging portion 31. Since the first engaging portion 27 is circular, it is centered by the inclined surface 31*a*. Therefore, the movement of the free end of the conveyance coil 21 is regulated by the inclined surface 31*a*, such that the first engaging portion 27 is supported by the inclined surface 31*a* and regulates the conveyance coil 21 from sinking into the opening portion 33, and the amount of movement of the free end of the conveyance coil 21 may be regulated compared to the conventional configuration.

According further to the toner conveyance apparatus 20 of the present embodiment, the regulation member 30 is formed in plane symmetry with respect to an orthogonal plane that is orthogonal to the center line C that passes the center position in the rotational axis direction AX. Therefore, the regulation member 30 can be assembled both normally and upside down to the conveyance path 23, such that assembly failures can be reduced and assembling workability can be improved.

According even further to the toner conveyance apparatus 20 of the present embodiment, the angle θ1 formed by the connecting portion 26 and the extended portion 25 satisfies 90°<θ1. Thus, there is no need to perform secondary processing of the conveyance coil 21 to set the angle θ1 to 90°, so that the increase of processing costs and processing time can be prevented.

According to the above-described embodiment, the regulation member 30 is formed in plane symmetry with respect to an orthogonal plane that is orthogonal to the center line C that passes the center position in the rotational axis direction AX, but the present invention is not restricted thereto. For example, with respect to the orthogonal plane, the rear side R may adopt the above-described second engaging portion 31 and the front side F may adopt an inclined portion having a different shape as the second engaging portion 31 (refer to FIG. 9A). In that case, two types of second engaging portions can be selectively attached using one regulation member, so that common use of component can be realized.

Second Embodiment

Figure 9A:
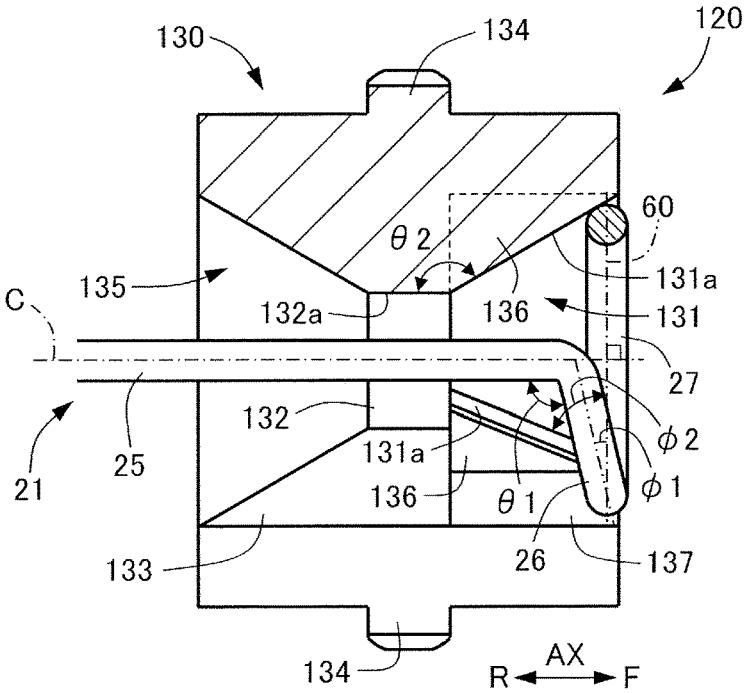
FIG. 9A is a cross-sectional side view illustrating a conveyance coil and a regulation member according to a second embodiment.
Figure 9B:
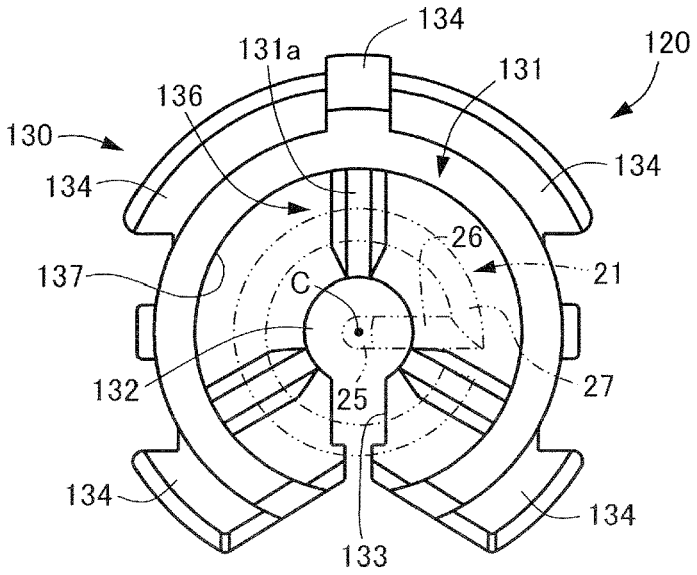
FIG. 9B is a front view illustrating the conveyance coil and the regulation member according to the second embodiment.

Next, a second embodiment of the present invention will be described in detail with reference to FIGS. 9A and 9B. A toner conveyance apparatus 120 of the present embodiment differs from the configuration of the first embodiment in that an inclined surface 131*a* of a second engaging portion 131 of a regulation member 130 is an inner circumferential surface of three or more ribs 136 arranged with intervals along the direction of rotation of the conveyance coil 21. The configurations other than that of the regulation member 130 are similar to the first embodiment, so that the same reference numbers are assigned and detailed descriptions thereof are omitted.

The regulation member 130 according to the present embodiment includes the second engaging portion 131, a storage portion 132, an opening portion 133, an inclined portion 135, and a fixing rib 134. A recessed portion 137 having an approximately cylindrical shape opened toward the front side F is formed on the front side F of the storage portion 132 of the regulation member 130. In the interior of the recessed portion 137, three ribs 136 are disposed every 120 degrees in the circumferential direction around the center line C. The surface of the ribs 136 facing the center line C is formed as an inclined surface 131*a* that is inclined such that the distance from the center line C of the conveyance coil 21 is gradually increased toward the front side F. The edge portions of the respective inclined surfaces 131*a* are chamfered or rounded.

Similar to the first embodiment, a maximum diameter of the inclined surface 131*a* is set to be greater than the maximum diameter of the first engaging portion 27 of the conveyance coil 21, and the conveyance coil 21 is always stored within the space of the inclined surface 131*a*. Further, the storage portion 132 includes an inner surface 132*a* that has a linear contour line along the rotational axis direction AX in a cross-section including the center line C. In the cross-section including the center line C, the angle formed by a contour line of the inclined surface 131*a* of the ribs 136 and a contour line of the inner surface 132*a* of the storage portion 132 is denoted as θ2. In this case, similar to the first embodiment, the conveyance coil 21 and the regulation member 130 are formed to satisfy the following: θ1<θ2 and 90°<θ2<180°. Also similar to the first embodiment, an angle ϕ1 formed by the connecting portion 26 and a plane 60 orthogonal to the rotational axis direction AX is defined as θ1 minus 90°. Further, an angle ϕ2 formed by the plane 60 and the inclined surface 131*a* of the second engaging portion 131 in the engaging position in which the first engaging portion 27 and the second engaging portion 131 are engaged is defined as θ2 minus 90°. In this state, since 90°<θ1<180° is satisfied, 0°<ϕ1<90° is satisfied, and since 90°<θ2<180° is satisfied, 0°<ϕ2<90° is satisfied. Further, since θ1<θ2 is satisfied, ϕ1<ϕ2 is satisfied, and since 90°<θ1<θ2<180° is satisfied, 0°<ϕ1<ϕ2<90° is satisfied.

Also according to the toner conveyance apparatus 120 of the present embodiment, since θ1<θ2 is satisfied, that is, since ϕ1<ϕ2 is satisfied, the connecting portion 26 of the conveyance coil 21 will not be in contact with the regulation member 130, and the first engaging portion 27 will always be in contact with the inclined surface 131*a* of the second engaging portion 131. Moreover, the rotation trajectory of the extended portion 25 and the connecting portion 26 has a gap with respect to the inclined surface 131*a* of the second engaging portion 131 and the inner surface 132*a* of the storage portion 132. Therefore, the sticking between the connecting portion 26 and the opening portion 133 causing abnormal noise will not generate, so that the generation of abnormal noise by the conveyance coil 21 and the regulation member 130 will be suppressed, and the noise of the toner conveyance apparatus 120 will be reduced.

Further according to the toner conveyance apparatus 120 of the present embodiment, three ribs 136 are provided, such that sudden changes of sliding contact points between the conveyance coil 21 and the regulation member 130 that may cause abnormal noise are reduced. By only providing three ribs 136, the amount of synthetic resin used for forming the regulation member 130 will be suppressed compared to a case where a continuous cone-shaped inclined surface 31*a* is provided. The number and arrangement of the ribs 136 is not restricted to the example described above, and for example, the number should at least be three, and can be four or greater.

According to the toner conveyance apparatus 120 of the present embodiment, a case has been illustrated where the ribs 136 are formed on the recessed portion 137 of the regulation member 130, but the present invention is not restricted to this example. For example, the ribs 136 may be formed on the cone-shaped inclined surface.

Third Embodiment

Figure 10A:
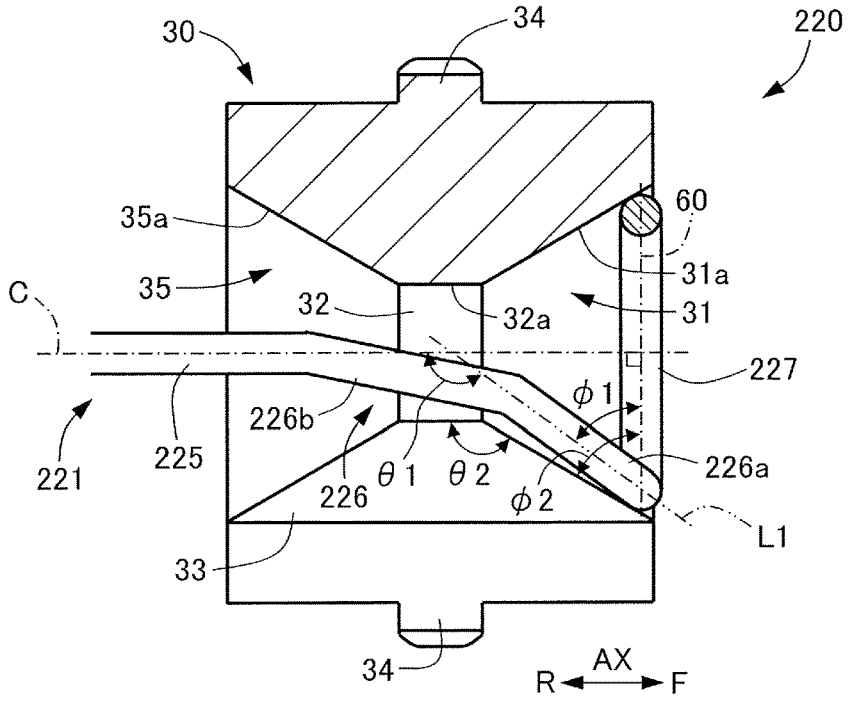
FIG. 10A is a cross-sectional side view illustrating a conveyance coil and a regulation member according to a third embodiment.

Next, a third embodiment of the present invention will be described in detail with reference to FIG. 10A. A toner conveyance apparatus 220 of the present embodiment differs from the configuration of the first embodiment in that a connecting portion 226 of a conveyance coil 221 includes a plurality of continuous linear portions 226*a* and 226*b* which are bent with respect to each other. The configurations other than that of the conveyance coil 221 are similar to the first embodiment, so the same reference numbers are assigned and detailed descriptions thereof are omitted.

The conveyance coil 221 according to the present embodiment includes a coil portion not shown, an extended portion 225, the connecting portion 226, and an engaging portion 227. The connecting portion 226 includes two continuous linear portions 226*a* and 226*b* which are bent with respect to each other. A first linear portion 226*a* is connected to the engaging portion 227, and a second linear portion 226*b* is connected to the extended portion 225. In this case, if the angle formed by the first linear portion 226*a* and the extended portion 225 is referred to as θ1, similar to the first embodiment, the conveyance coil 221 and the regulation member 30 are formed to satisfy the following: θ1<θ2 and 90°<θ2<180°. That is, θ1 is set as an angle formed by a center line L1 of the first linear portion 226*a* closest to the engaging portion 227 among the plurality of linear portions 226*a* and 226*b* and a center line C of the extended portion 225 formed linearly along the rotational axis direction AX. In this case, an angle ϕ1 formed by the connecting portion 226 and a plane 60 orthogonal to the rotational axis direction AX corresponds to the angle formed by the center line L1 of the linear portion 226*a* and the plane 60, defined as θ1 minus 90°. Further, an angle formed by the first linear portion 226*a* and the second linear portion 226*b* and an angle formed by the second linear portion 226*b* and the extended portion 225 are both greater than θ2. Meanwhile, according to the present embodiment, the angle formed by the first linear portion 226*a* and the extended portion 225 is set to θ1, such that θ1<θ2 is realized.

Also according to the toner conveyance apparatus 220 of the present embodiment, since θ1<θ2 is satisfied, that is, since ϕ1<ϕ2 is satisfied, the connecting portion 226 of the conveyance coil 221 will not be in contact with the regulation member 30, and the engaging portion 227 will always be in contact with the inclined surface 31*a* of the second engaging portion 31. Moreover, the rotation trajectory of the extended portion 225 and the connecting portion 226 has a gap with respect to the inclined surface 31*a* of the second engaging portion 31 and the inner surface 32*a* of the storage portion 32 (refer to FIG. 6A). Therefore, the sticking between the connecting portion 226 and the opening portion 33 causing abnormal noise will not generate, so that the generation of abnormal noise by the conveyance coil 221 and the regulation member 30 will be suppressed, and the noise of the toner conveyance apparatus 220 will be reduced.

According to the present embodiment, the connecting portion 226 of the conveyance coil 221 includes two linear portions 226*a* and 226*b* which are bent with respect to each other, but the present invention is not restricted to this example. For example, the connecting portion 226 can have three or more linear portions that are bent with respect to each other. As described, if there are a plurality of angles formed by the connecting portion 226 and the extended portion 225 along the rotational axis direction AX, the angle θ1 formed by the connecting portion 226 and the extended portion 225 is set to the angle formed by the extended portion 225 and the linear portion positioned closest to the engaging portion 227 of the connecting portions 226. Similarly, if there are a plurality of angles formed by the connecting portion 226 and the extended portion 225 along the rotational axis direction AX, the angle ϕ1 formed by the connecting portion 226 and the plane 60 orthogonal to the rotational axis direction AX is set to the angle formed by the plane 60 and the linear portion positioned closest to the engaging portion 227 of the connecting portion 226. Thereby, since θ1<θ2 is satisfied, that is, ϕ1<ϕ2 is satisfied, the connecting portion 226 of the conveyance coil 221 is prevented from being in contact with the regulation member 30.

Fourth Embodiment

Figure 10B:
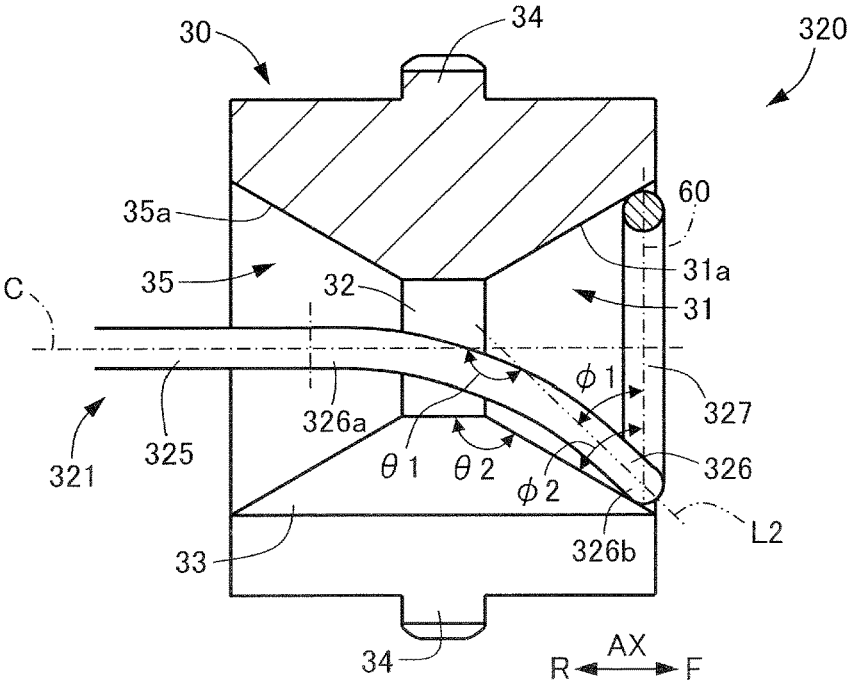
FIG. 10B is a cross-sectional side view illustrating a conveyance coil and a regulation member according to a fourth embodiment.

Next, a fourth embodiment of the present invention will be described in detail with reference to FIG. 10B. A toner conveyance apparatus 320 of the present embodiment differs from the configuration of the first embodiment in that a connecting portion 326 of a conveyance coil 321 is curved. The configurations other than that of the conveyance coil 321 are similar to the first embodiment, so the same reference numbers are assigned and detailed descriptions thereof are omitted.

The conveyance coil 321 according to the present embodiment includes a coil portion not shown, an extended portion 325, the connecting portion 326, and an engaging portion 327. The connecting portion 326 includes a first end portion 326*a* connected to the extended portion 325, and a second end portion 326*b* connected to a first engaging portion 327 and arranged toward a front side F than the first end portion 326*a*. The connecting portion 326 is curved so that the angle formed by a tangent L2 that passes the second end portion 326*b* on the engaging portion 327 side and the center line C of the extended portion 325 formed linearly along the rotational axis direction AX is set to θ1. Similar to the first embodiment, the conveyance coil 321 and the regulation member 30 are formed to satisfy the following: θ1<θ2 and 90°<θ2<180°. In this case, an angle ϕ1 formed by the connecting portion 326 and a plane 60 orthogonal to the rotational axis direction AX corresponds to the angle formed by the plane 60 and the tangent L2 of the second end portion 326*b* on the side of the engaging portion 327 of the connecting portion 326, defined as θ1 minus 90°. Since the connecting portion 326 is curved, θ1>θ2 may be the case depending on the position of the tangent. Meanwhile, according to the present embodiment, the angle formed by the tangent L2 passing the second end portion 326*b* on the engaging portion 327 side and the center line C of the extended portion 325 is set to θ1, such that θ1<θ2 is realized. If the connecting portion 326 is curved, the angle θ1 formed by the extended portion 325 and the connecting portion 326 is set to the angle formed by the tangent L2 of the second end portion 326*b* on the engaging portion 327 side of the connecting portion 326 and the center line C of the extended portion 325. Similarly, if the connecting portion 326 is curved, the angle ϕ1 formed by the connecting portion 326 and the plane 60 orthogonal to the rotational axis direction AX is set to the angle formed by the plane 60 and the tangent L2 of the second end portion 326*b* on the engaging portion 327 side of the connecting portion 326.

Also according to the toner conveyance apparatus 320 of the present embodiment, since θ1<θ2 is satisfied, that is, since ϕ1<ϕ2 is satisfied, the connecting portion 326 of the conveyance coil 321 will not be in contact with the regulation member 30, and the engaging portion 327 will always be in contact with the inclined surface 31*a* of the second engaging portion 31. Moreover, the rotation trajectory of the extended portion 325 and the connecting portion 326 has a gap with respect to the inclined surface 31*a* of the second engaging portion 31 and the inner surface 32*a* of the storage portion 32 (refer to FIG. 6A). Therefore, the sticking between the connecting portion 326 and the opening portion 33 causing abnormal noise will not generate, so that the generation of abnormal noise by the conveyance coil 321 and the regulation member 30 will be suppressed, and the noise of the toner conveyance apparatus 320 will be reduced.

Fifth Embodiment

Figure 11A:
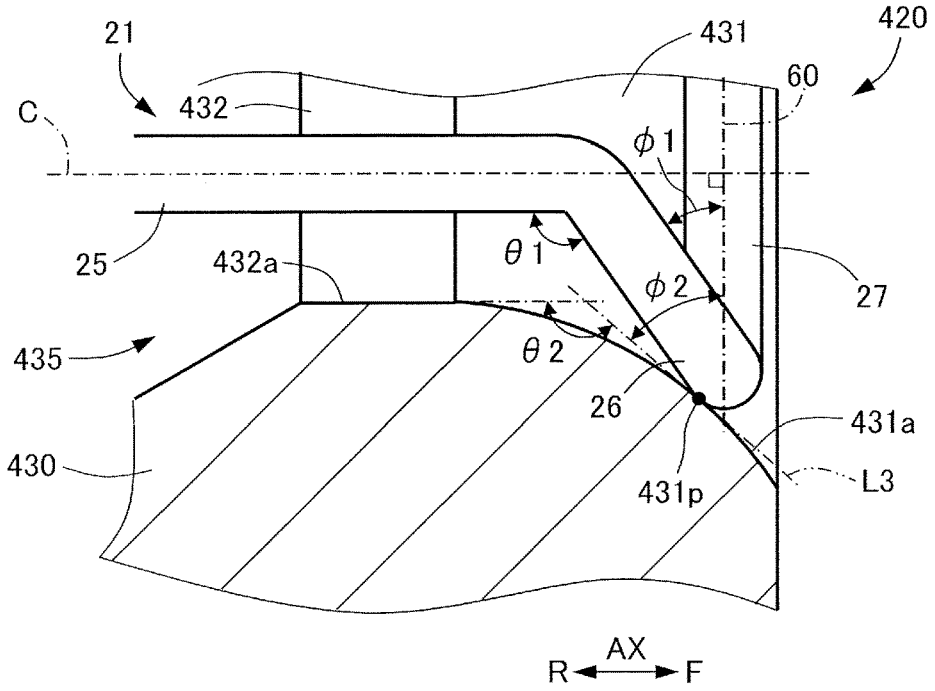
FIG. 11A is an enlarged cross-sectional side view illustrating a conveyance coil and a regulation member according to a fifth embodiment.

Next, a fifth embodiment of the present invention will be described in detail with reference to FIG. 11A. A toner conveyance apparatus 420 of the present embodiment differs from the configuration of the first embodiment in that in a cross-section including the center line C, a contour line of an inclined surface 431*a* of a second engaging portion 431 of a regulation member 430 is not linear but is curved to protrude toward the center line C. The configurations other than that of the regulation member 430 are similar to the first embodiment, so the same reference numbers are assigned and detailed descriptions thereof are omitted.

The regulation member 430 according to the present embodiment includes the second engaging portion 431, a storage portion 432, an opening portion not shown, and an inclined portion 435. The opening portion is provided at a portion of the second engaging portion 431 and has a width wide enough for the connecting portion 26 to enter therethrough, similar to the first embodiment. The second engaging portion 431 is formed so that the contour line of the inclined surface 431*a* in the cross-section including the center line C is curved to protrude toward the center line C. The storage portion 432 includes an inner surface 432*a* having a contour line that is linear along the rotational axis direction AX in the cross-section including the center line C. In the cross-section including the center line C, the angle formed by a tangent L3 of an abutment position 431*p* of the first engaging portion 27 in the second engaging portion 431 and a contour line of the inner surface 432*a* of the storage portion 432 is denoted as θ2. In this case, similar to the first embodiment, the conveyance coil 21 and the regulation member 430 are formed to satisfy the following: θ1<θ2 and 90°<θ2<180°. Also similar to the first embodiment, an angle ϕ1 formed by the connecting portion 26 and a plane 60 orthogonal to the rotational axis direction AX is defined as θ1 minus 90°. Further, an angle ϕ2 formed by the plane 60 and the second engaging portion 431 in the engaging position in which the first engaging portion 27 and the second engaging portion 431 are engaged is defined as θ2 minus 90°. In this state, since 90°<θ1<180° is satisfied, 0°<ϕ1<90° is satisfied, and since 90°<θ2<180° is satisfied, 0°<ϕ2<90° is satisfied. Further, since θ1<θ2 is satisfied, ϕ1<ϕ2 is satisfied, and since 90°<θ1<θ2<180° is satisfied, 0°<ϕ1<ϕ2<90° is satisfied. The contour line of the inner surface 432*a* of the storage portion 432 corresponds to a virtual line that is continued linearly from an end portion on a rear side R of the contour line of the inclined surface 431*a* to the rear side R.

Also according to the toner conveyance apparatus 420 of the present embodiment, since θ1<θ2 is satisfied, that is, since ϕ1<ϕ2 is satisfied, the connecting portion 26 of the conveyance coil 21 will not be in contact with the regulation member 430, and the first engaging portion 27 will always be in contact with the inclined surface 431*a* of the second engaging portion 431. Moreover, the rotation trajectory of the extended portion 25 and the connecting portion 26 has a gap with respect to the inclined surface 431*a* of the second engaging portion 431 and the inner surface 432*a* of the storage portion 432. Therefore, the sticking between the connecting portion 26 and the opening portion causing abnormal noise will not generate, so that the generation of abnormal noise by the conveyance coil 21 and the regulation member 430 will be suppressed, and the noise of the toner conveyance apparatus 420 will be reduced.

Sixth Embodiment

Figure 11B:
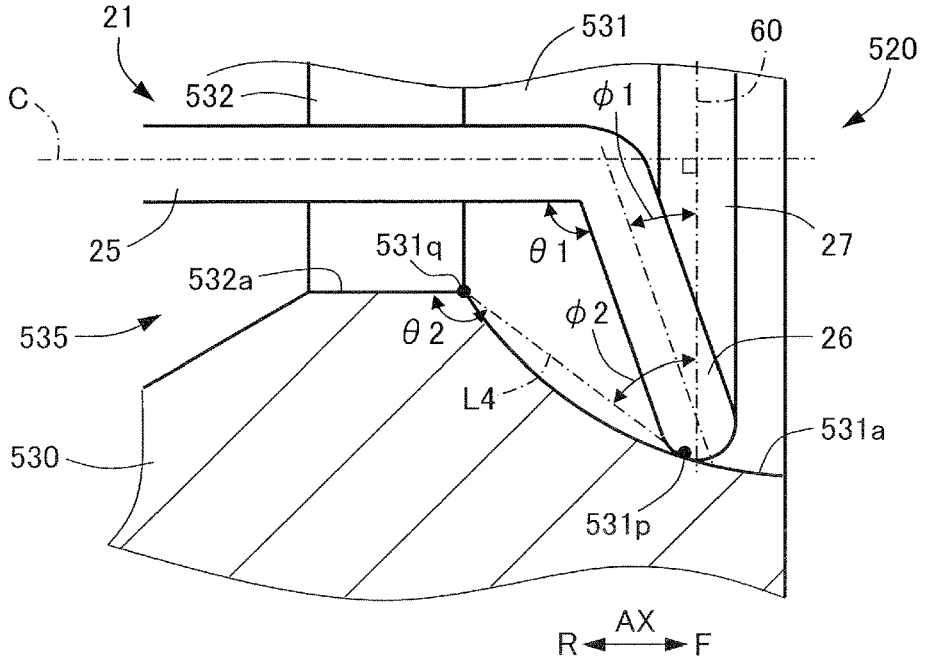
FIG. 11B is an enlarged cross-sectional side view illustrating a conveyance coil and a regulation member according to a sixth embodiment.

Next, a sixth embodiment of the present invention will be described in detail with reference to FIG. 11B. A toner conveyance apparatus 520 of the present embodiment differs from the configuration of the first embodiment in that in a cross-section including the center line C, a contour line of an inclined surface 531*a* of a second engaging portion 531 of a regulation member 530 is not linear but is curved to protrude to an opposite side from the center line C. The configurations other than that of the regulation member 530 are similar to the first embodiment, so the same reference numbers are assigned and detailed descriptions thereof are omitted.

The regulation member 530 according to the present embodiment includes the second engaging portion 531, a storage portion 532, an opening portion not shown, and an inclined portion 535. The opening portion is provided at a portion of the second engaging portion 531 and has a width wide enough for the connecting portion 26 to enter therethrough, similar to the first embodiment. The second engaging portion 531 is formed so that the contour line of the inclined surface 531*a* in the cross-section including the center line C is curved to protrude to the opposite side from the center line C. The storage portion 532 includes an inner surface 532*a* having a contour line that is linear along the rotational axis direction AX in the cross-section including the center line C. In the cross-section including the center line C, an angle formed by a straight line L4 connecting an abutment portion 531*p* of the first engaging portion 27 in the second engaging portion 531 and an end portion 531*q* of a rear side R of a contour line of the inclined surface 531*a* and a contour line of the inner surface 532*a* of the storage portion 532 is denoted as θ2. In this case, similar to the first embodiment, the conveyance coil 21 and the regulation member 530 are formed to satisfy the following: θ1<θ2 and 90°<θ2<180°. Also similar to the first embodiment, an angle ϕ1 formed by the connecting portion 26 and a plane 60 orthogonal to the rotational axis direction AX is defined as θ1 minus 90°. Further, an angle ϕ2 formed by the plane 60 and the second engaging portion 531 in the engaging position in which the first engaging portion 27 and the second engaging portion 531 are engaged is defined as θ2 minus 90°. In this state, since 90°<θ1<180° is satisfied, 0°<ϕ1<90° is satisfied, and since 90°<θ2<180° is satisfied, 0°<ϕ2<90° is satisfied. Further, since θ1<θ2 is satisfied, ϕ1<ϕ2 is satisfied, and since 90°<θ1<θ2<180° is satisfied, 0°<ϕ1<ϕ2<90° is satisfied. The contour line of the inner surface 532*a* of the storage portion 532 corresponds to a virtual line that is continued linearly from an end portion 531*q* on a rear side R of the contour line of the inclined surface 531*a* to the rear side R.

Also according to the toner conveyance apparatus 520 of the present embodiment, since θ1<θ2 is satisfied, that is, since ϕ1<ϕ2 is satisfied, the connecting portion 26 of the conveyance coil 21 will not be in contact with the regulation member 530, and the first engaging portion 27 will always be in contact with the inclined surface 531*a* of the second engaging portion 531. Moreover, the rotation trajectory of the extended portion 25 and the connecting portion 26 has a gap with respect to the inclined surface 531*a* of the second engaging portion 531 and the inner surface 532*a* of the storage portion 532. Therefore, the sticking between the connecting portion 26 and the opening portion causing abnormal noise will not generate, so that the generation of abnormal noise by the conveyance coil 21 and the regulation member 530 will be suppressed, and the noise of the toner conveyance apparatus 520 will be reduced.

Seventh Embodiment

Figure 12A:
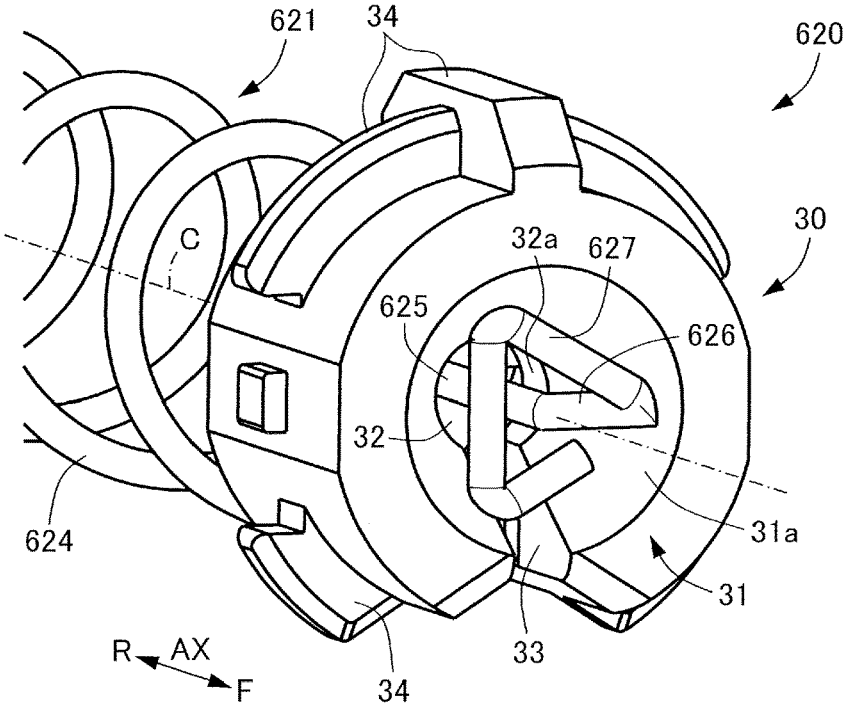
FIG. 12A is a perspective view illustrating a conveyance coil and a regulation member in a toner conveyance apparatus according to a seventh embodiment.
Figure 12B:
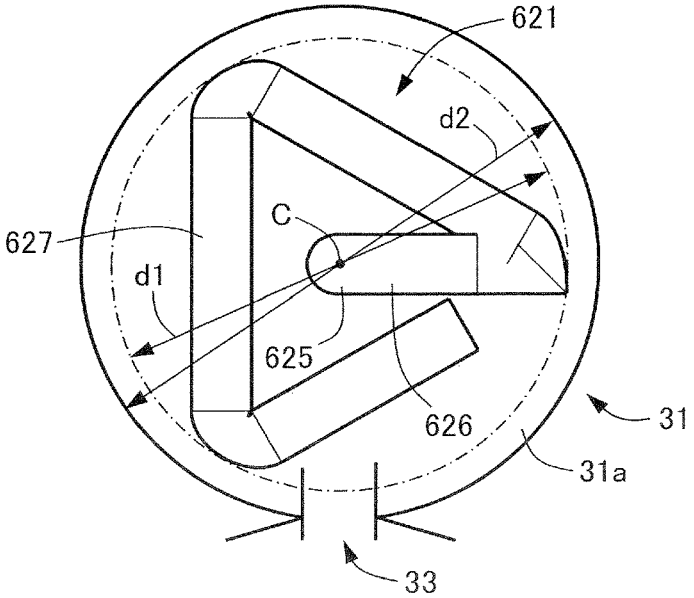
FIG. 12B is a front view illustrating the conveyance coil in the toner conveyance apparatus according to the seventh embodiment.

Next, a seventh embodiment of the present invention will be described in detail with reference to FIGS. 12A and 12B. A toner conveyance apparatus 620 of the present embodiment differs from the configuration of the first embodiment in that a first engaging portion 627 of a conveyance coil 621 adopts an approximately equilateral triangular shape when viewed from the rotational axis direction AX. The configurations other than that of the conveyance coil 621 are similar to the first embodiment, so the same reference numbers are assigned and detailed descriptions thereof are omitted.

The conveyance coil 621 according to the present embodiment includes a coil portion 624, an extended portion 625, a connecting portion 626, and a first engaging portion 627. The first engaging portion 627 is formed approximately in a polygonal shape when viewed from the rotational axis direction AX, and especially, it is formed by being bent in an approximately equilateral triangular shape. Therefore, the first engaging portion 627 is in contact at three points with the inclined surface 31*a*. As illustrated in FIG. 12B, a maximum diameter d2 of the inclined surface 31*a* is set to be greater than a maximum outer diameter d1 of a circumscribed circle of the first engaging portion 627. Therefore, the first engaging portion 627 of the conveyance coil 621 is always stored within the space of the cone-shaped inclined surface 31*a*. Then, similar to the first embodiment, the conveyance coil 621 and the regulation member 30 are formed to satisfy the following: $\theta 1<\theta 2$ and $90°<\eta 2<180°$. Also similar to the first embodiment, an angle $\phi 1$ formed by the connecting portion 626 and a plane 60 orthogonal to the rotational axis direction AX (refer to FIG. 17) is defined as $\theta 1$ minus 90°. Further, an angle $\phi 2$ formed by the plane 60 and the second engaging portion 31 in the engaging position in which the first engaging portion 627 and the second engaging portion 31 are engaged is defined as $\theta 2$ minus 90°. In this state, since $90°<\theta 1<180°$ is satisfied, $0°<\phi 1<90°$ is satisfied, and since $90°<\theta 2<180°$ is satisfied, $0°<\phi 2<90°$ is satisfied. Further, since $\theta 1<\theta 2$ is satisfied, $\phi 1<\phi 2$ is satisfied, and since $90°<\theta 1<\theta 2<180°$ is satisfied, $0°<\phi 1<\phi 2<90°$ is satisfied.

Also according to the toner conveyance apparatus 620 of the present embodiment, since $\theta 1<\theta 2$ is satisfied, that is, since $\phi 1<\phi 2$ is satisfied, the connecting portion 626 of the conveyance coil 621 will not be in contact with the regulation member 30, and the first engaging portion 627 will always be in contact with the inclined surface 31*a* of the second engaging portion 31. Moreover, the rotation trajectory of the extended portion 625 and the connecting portion 626 has a gap with respect to the inclined surface 31*a* of the second engaging portion 31 and the inner surface 32*a* of the storage portion 32. Therefore, the sticking between the connecting portion 626 and the opening portion 33 causing abnormal noise will not generate, so that the generation of abnormal noise by the conveyance coil 621 and the regulation member 30 will be suppressed, and the noise of the toner conveyance apparatus 620 will be reduced.

According to the toner conveyance apparatus 620 of the present embodiment, an example has been described where the first engaging portion 627 adopts an approximately equilateral triangular shape, but the present invention is not restricted to this example, and for example, a triangular shape other than the equilateral triangle or other polygonal shapes such as a rectangle can be adopted.

Figure 16B:
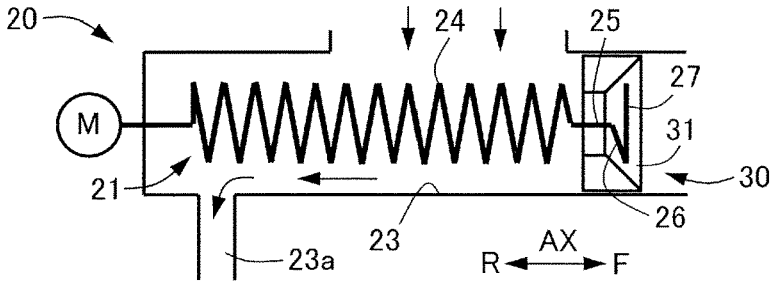
FIG. 16B is a cross-sectional view of the toner conveyance apparatus in which the toner conveyance direction is from the front side toward the rear side and the motor is arranged on the rear side.
Figure 16C:
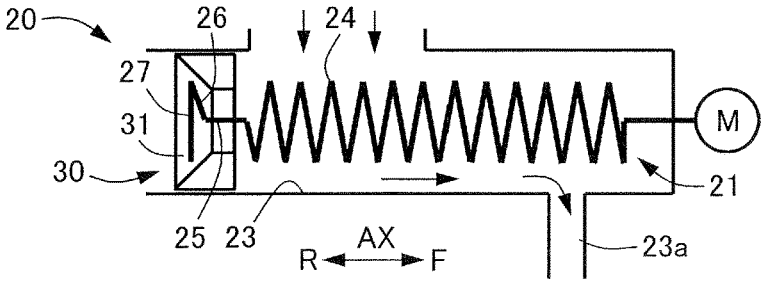
FIG. 16C is a cross-sectional view of the toner conveyance apparatus in which the toner conveyance direction is from the rear side toward the front side and the motor is arranged on the front side.
Figure 16D:
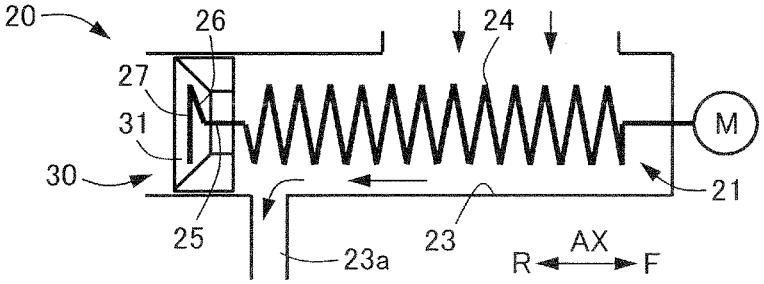
FIG. 16D is a cross-sectional view of the toner conveyance apparatus in which the toner conveyance direction is from the front side toward the rear side and the motor is arranged on the front side.

In the first through seventh embodiments described above, as illustrated in FIG. 16A, an example has been illustrated where the toner conveyance direction, i.e., predetermined direction, is the frontward direction from the rear side, i.e., the other end side, R toward the front side, i.e., one end side, F, and where the motor M is arranged on the rear side R, but the present invention is not restricted to this example. For example, as illustrated in FIG. 16B, the toner conveyance direction, i.e., predetermined direction, may be the rearward direction from the front side, i.e. one end side, F toward the rear side, i.e., the other end side, R, and the motor M may be arranged on the rear side R. Further, as illustrated in FIG. 16C, the toner conveyance direction, i.e., predetermined direction, may be the frontward direction from the rear side, i.e., one end portion, R toward the front side i.e., the other end portion, F, and the motor M may be arranged on the front side F. Further, as illustrated in FIG. 16D, the toner conveyance direction, i.e., predetermined direction, may the rearward direction from the front side, i.e., the other end portion, F toward the rear side, i.e., one end portion, R, and the motor M may be arranged on the front side F. In any case, the connecting portion will not be caught in the opening portion and cause abnormal noise, such that the generation of abnormal noise by the conveyance coil and the regulation member can be suppressed, and the reduction of noise of the toner conveyance apparatus can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-013001, filed Jan. 29, 2018, which is hereby incorporated by reference herein in its entirety.

What is claimed is:

1. A toner conveyance apparatus comprising:

a conveyance coil that is provided rotatably and configured to convey toner in a conveyance path, the conveyance coil comprising a coil portion wound helically around a rotational axis of the conveyance coil, an extended portion extending along a rotational axis direction from the coil portion, a first engaging portion provided around the rotational axis of the conveyance coil to engage an end portion on one end side of the conveyance coil, and a connecting portion, bending toward an outside in a radial direction of the conveyance coil and extending in the radial direction of the conveyance coil, configured to connect the extended portion and the first engaging portion; and a regulation member provided non-rotatably in the conveyance path and engaging with the first engaging portion and regulating the first engaging portion from moving to the other end side in a state where the end portion on the one end side of the conveyance coil attempts to move toward the other end side, wherein the regulation member comprises a second engaging portion that is engaged with the first engaging portion, a space portion through which the extended portion passes, and an opening portion that is opened to a radial direction of the conveyance coil, wherein the extended portion is arranged into the space portion through the opening portion, wherein the connecting portion comprises a first end portion that is connected to the extended portion and a second end portion that is connected to the first engaging portion, the first end portion being arranged further on the other end side than the second end portion, and wherein the second engaging portion comprises a diameter reduction area whose distance in a radial distance from the rotational axis is reduced gradually toward the other end side such that the connecting portion and the regulation member are not in contact with each other in a state where the conveyance coil is driven.

2. The toner conveyance apparatus according to claim 1, wherein the second engaging portion has a truncated cone shape that is continuous in a circumferential direction excluding the opening portion with respect to a direction of rotation of the conveyance coil.

3. The toner conveyance apparatus according to claim 1, wherein the first engaging portion has a circular shape.

4. The toner conveyance apparatus according to claim 1, wherein an inner diameter of the space portion is smaller than a maximum outer diameter of the first engaging portion.

5. The toner conveyance apparatus according to claim 1, wherein an angle $\theta 1$ formed by the connecting portion and the extended portion satisfies $90° < \theta 1$.

6. The toner conveyance apparatus according to claim 1, wherein the regulation member is formed to be symmetrical with respect to a plane orthogonal to the rotational axis of the conveyance coil, the plane passing a center position of the regulation member with respect to the rotational axis direction.

7. The toner conveyance apparatus according to claim 1, wherein an angle $\phi 1$ formed by the connecting portion and a plane orthogonal to the rotational axis direction is smaller than an angle $\phi 2$ formed by the plane and the second engaging portion in an engaging position where the first engaging portion and the second engaging portion are engaged.

8. The toner conveyance apparatus according to claim 1, wherein the conveyance coil is formed of a single wire.

9. An image bearing member unit comprising:

an image bearing member configured to bear a toner image and move;

a cleaning member configured to remove toner on the image bearing member; and the toner conveyance apparatus according to claim 1 configured to convey toner removed by the cleaning member.

10. A toner conveyance apparatus comprising:

a conveyance coil that is provided rotatably and configured to convey toner in a conveyance path, the conveyance coil comprising a coil portion wound helically around a rotational axis of the conveyance coil, an extended portion extending along a rotational axis direction from the coil portion, a first engaging portion provided around the rotational axis of the conveyance coil to engage an end portion on one end side of the conveyance coil, and a connecting portion, bending toward an outside in a radial direction of the conveyance coil and extending in the radial direction of the conveyance coil, configured to connect the extended portion and the first engaging portion; and a regulation member provided non-rotatably in the conveyance path and engaging with the first engaging portion and regulating the first engaging portion from moving to the other end side in a state where the end portion on the one end side of the conveyance coil attempts to move toward the other end side, wherein the regulation member comprises a second engaging portion that is engaged with the first engaging portion, a space portion through which the extended portion passes, and an opening portion that is opened to a radial direction of the conveyance coil, wherein the extended portion is arranged into the space portion through the opening portion, wherein the connecting portion comprises a first end portion that is connected to the extended portion and a second end portion that is connected to the first engaging portion, the first end portion being arranged further on the other end side than the second end portion, and wherein an angle $\phi 1$ formed by the connecting portion and a plane orthogonal to the rotational axis direction is smaller than an angle $\phi 2$ formed by the plane and the second engaging portion in an engaging position where the first engaging portion and the second engaging portion are engaged.

11. The toner conveyance apparatus according to claim 10, wherein the second engaging portion has a truncated cone shape that is continuous in a circumferential direction excluding the opening portion with respect to a direction of rotation of the conveyance coil.

12. The toner conveyance apparatus according to claim 10, wherein the first engaging portion has a circular shape.

13. The toner conveyance apparatus according to claim 10, wherein an inner diameter of the space portion is smaller than a maximum outer diameter of the first engaging portion.

14. The toner conveyance apparatus according to claim 10, wherein the angle $\phi 1$ satisfies $0° < \phi 1 < 90°$.

15. The toner conveyance apparatus according to claim 10, wherein the regulation member is formed to be symmetrical with respect to a plane orthogonal to the rotational axis of the conveyance coil, the plane passing a center position of the regulation member with respect to the rotational axis direction.

16. The toner conveyance apparatus according to claim 10, wherein the angle $\phi 2$ satisfies $0° < \phi 2 < 90°$.

17. The toner conveyance apparatus according to claim 10, wherein the conveyance coil is formed of a single wire.

18. An image bearing member unit comprising:

an image bearing member configured to bear a toner image and move;

a cleaning member configured to remove toner on the image bearing member; and the toner conveyance apparatus according to claim 10 configured to convey toner removed by the cleaning member.

* * * * *